US006580423B1

(12) United States Patent
Murade

(10) Patent No.: US 6,580,423 B1
(45) Date of Patent: Jun. 17, 2003

(54) DRIVING CIRCUIT FOR ELECTRO-OPTICAL DEVICE, ELECTRO-OPTICAL DEVICE, AND ELECTRONIC APPARATUS

(75) Inventor: Masao Murade, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/384,539

(22) Filed: Aug. 27, 1999

(30) Foreign Application Priority Data

Sep. 3, 1998 (JP) ..... 10-250129

(51) Int. Cl.[7] ..... G09G 5/00
(52) U.S. Cl. ..... 345/204; 345/80; 257/72
(58) Field of Search ..... 345/204, 80; 257/72; 349/151, 73; 438/164

(56) References Cited

U.S. PATENT DOCUMENTS 5,589,406 A * 12/1996 Kato et al. ..... 438/164
5,764,206 A * 6/1998 Koyama et al. ..... 345/80
5,789,763 A * 8/1998 Kato et al. ..... 257/72
6,014,193 A * 1/2000 Taira et al. ..... 349/73
6,335,778 B1 * 1/2002 Kubota et al. ..... 349/151

* cited by examiner

*Primary Examiner*—Steven Saras
*Assistant Examiner*—Uchendu O. Anyaso
(74) *Attorney, Agent, or Firm*—Oliff & Berridge, PLC

(57) ABSTRACT

A device is miniaturized by efficiently using an area on a substrate in a liquid-crystal device, and the like, of a type in which a driving circuit is contained and plural data lines are driven simultaneously. On a substrate of a liquid-crystal device, a sampling circuit for sampling an image signal, and a data line driving circuit for supplying a sampling control signal simultaneously to each group of sampling switches connected to plural adjacent data lines are provided. The data line driving circuit includes a buffer circuit including inverters having thin-film transistors for shaping the waveform of a transfer signal which is input from a shift register circuit and for outputting it as a sampling control signal in such a manner as to correspond to each latch circuit. This thin-film transistor, whose direction of its channel width is in the horizontal direction, includes a channel portion having a channel width equal to the width of plural data lines.

21 Claims, 15 Drawing Sheets

N-CHANNEL-TYPE TFT

P-CHANNEL-TYPE TFT

COMPLEMENTARY TFT

DRIVING CIRCUIT FOR ELECTRO-OPTICAL DEVICE, ELECTRO-OPTICAL DEVICE, AND ELECTRONIC APPARATUS

BACKGROUND OF THE INVENTION

1. Field of Invention

The present invention belongs to the technological fields of a driving circuit including a data line driving circuit for driving an electro-optical device, such as a liquid-crystal apparatus of an active-matrix transistor driving method, such as a thin-film transistor (hereinafter referred to as a "TFT" where appropriate), and an electro-optical device of a type incorporating such a driving circuit. More particularly, the present invention belongs to the technological fields of a driving circuit for an electro-optical device, which adopts a driving method for driving plural data lines simultaneously in order to support high dot frequencies and color image signals, and an electro-optical device of a type incorporating such a driving circuit.

2. Description of Related Art

This type of driving circuit for an electro-optical device includes a data line driving circuit, a scanning line driving circuit, and a sampling circuit and the like, which are used to supply image signals and scanning signals at a predetermined timing to data lines and scanning lines wired in an image display area of an electro-optical device.

Such a driving circuit is constructed so that when a line sequential driving method is adopted, image signals which are supplied to one image signal line from an external source are sampled by plural sampling switches provided in such a manner as to correspond to each data line, respectively, in accordance with a sampling control signal which is supplied in sequence in such a manner as to correspond to each data line from the data line driving circuit, and are supplied to each data line based on the line sequence. Also, generally, the data line driving circuit includes a shift register circuit including plural arranged latch circuits which output a transfer signal in sequence according to a reference clock. Furthermore, the construction is formed in such a way that a buffer circuit is interposed between this latch circuit and the sampling circuit, and the waveform of the transfer signal is shape to become the sampling control signal, and even if the driving performance of the latch circuit is not sufficient to drive the sampling switch, the load of the sampling switch can be sufficiently dealt with by the buffer circuit.

Here, in response to the demand for higher quality of display images in recent years, the dot frequency in an electro-optical device, such as a liquid-crystal device, is becoming increasingly higher, for example, as in an XGA method, an SXGA method, or an EWS method. When the dot frequency is increased in this manner, the sampling performance in the sampling switch becomes insufficient, and the delay time in each TFT, which is an element of the driving circuit, exerts an adverse influence upon the quality of the display image. For example, a problem arises in that an image signal for the previous data line is written into the next data line, causing ghost or crosstalk. However, if the performance of the sampling switch and each TFT is increased to deal with this problem, a substantial increase in cost will occur.

For this reason, recently, a technology described below has been developed. For example, an image signal is converted from serial into parallel form in advance so that the image signal is divided into plural parallel image signals, or the image signal is divided into parallel image signals for each color in the case of a color image signal, after which the image signals are supplied to plural image signal lines provided in an electro-optical device. In the sampling circuit, plural parallel image signals which are converted from serial into parallel form are sampled simultaneously, and are supplied to a plurality (for example, 6, 12, 24 lines, and the like) of data lines at the same time. According to this technology, since the time each sampling switch performs sampling can be increased about n times according to the number of data lines n which are driven simultaneously, the driving frequency in the driving circuit can be substantially decreased to about 1/n. That is, there is no need to improve the performance itself of the sampling switches and each TFT as described above, and it is possible to cope with a high dot frequency.

In a case in which plural data lines are driven simultaneously in this manner, since a sampling control signal is supplied simultaneously or the same sampling control signal is supplied to plural sampling switches, the data line driving circuit requires driving performance capable of withstanding a total of loads of the plural sampling switches. That is, the driving performance of the buffer circuit interposed between the latch circuit and the sampling switch must be increased according to the total of loads of the plural sampling switches. For this purpose, the size of the TFT which is an element of the inverter included in the buffer circuit need only be increased. However, if the size of the TFT is simply increased, there occurs the need to increase the driving performance in the latch circuit for driving this TFT by a transfer signal, causing the power consumption in the shift register circuit in which, in particular, the large amount of the power consumption is conventionally deemed to be problematical in the field of the relevant electro-optical device, to be increased even more. Accordingly, a construction is generally adopted in which the buffer circuit is formed of inverters of plural stages which are connected in series so that the driving performance in the buffer circuit is increased in a stepped manner for each inverter. That is, a construction is adopted in which the size of the TFT which is an element of an inverter of a stage on the side of the latch circuit of the buffer circuit is small and the size of the TFT which is an element of an inverter of a stage on the side of the sampling switch of the buffer circuit is large.

On the other hand, an electro-optical device of a driving circuit built-in type has been developed in which a driving circuit such as that described above is provided on a substrate which is an element of the main unit of an electro-optical device, such as a liquid-crystal device. This electro-optical device of a driving circuit built-in type is advantageous in achieving an overall reduction in size of the device and a decrease in cost in comparison with an electro-optical device of a type in which a driving circuit is formed on a separate substrate and is provided externally.

However, if the above-mentioned buffer circuit formed of plural stages is provided in the above-mentioned liquid-crystal device of a driving circuit built-in type, an increase in the occupied area by the buffer circuit having a larger size on the substrate of a liquid-crystal device, and the like, becomes a problem. In particular, as in the above-mentioned conventional liquid-crystal apparatus of a line sequential driving method, if each inverter is formed of TFTs extending in a longitudinal direction along the data lines and this is connected in series in a longitudinal direction at plural stages along the data lines, conventionally, there is the problem in that the ratio of the ineffective use area by the buffer circuit, which occupies an area on a horizontally elongated substrate along the scanning lines present between the image signal lines and the shift register circuit, is increased. Ultimately, a non-image display area for forming a data line driving circuit in the upper or lower portion of the image display area is extended, resulting in a problem in that a situation is brought about which is contrary to a general demand for a smaller size and a lighter weight of the overall device and a larger area of the image display area of the same device size in the technological field of the relevant electro-optical device.

SUMMARY OF THE INVENTION

The present invention has been achieved in view of the above-described problems. A driving circuit for an electro-optical device is provided, which is capable of achieving a smaller size of the device or a larger size of the image display area of the same device size by efficiently using an area on a substrate in an electro-optical device such as a liquid-crystal device, which is a driving circuit built-in type and which adopts a driving method for driving plural data lines simultaneously, and to provide an electro-optical device incorporating the driving circuit.

To solve the above-mentioned problems, the driving circuit for an electro-optical device in accordance with the present invention is a driving circuit for an electro-optic device including an electro-optical material sandwiched between a pair of substrates, and plural data lines and plural scanning lines which intersect each other on one substrate of the pair of substrates, the driving circuit comprising: plural sampling switches provided on one of the substrates, for sampling image signals in accordance with a sampling control signal and for supplying the image signals to the plural data lines, respectively, and a data line driving circuit that supplies the sampling control signal simultaneously to each group of sampling switches connected to n (n is an integer of 2 or more) data lines adjacent to the plural sampling switches, the data line driving circuit comprising a shift register circuit that sequentially outputs a transfer signal from each of a plurality of latch circuits, and a buffer circuit that outputs the transfer signal as the sampling control signal, and at least one transistor of the buffer circuit extends in a same direction as a direction in which a width of the channel thereof intersects the data lines on one of the substrates.

According to the driving circuit for an electro-optical device in accordance with the present invention, a sampling control signal is supplied by the data line driving circuit to n sampling switches simultaneously to each group of sampling switches connected to n adjacent data lines. At this time, in the data line driving circuit, a transfer signal is output in sequence by a shift register circuit, and this transfer signal is output as the above-mentioned sampling control signal via a buffer circuit. Then, an image signal is sampled by each sampling switch in accordance with the sampling control signal and is supplied to the plural data lines, respectively. In this manner, by driving the plural sampling switches simultaneously, it is possible to drive the data lines in such a manner as to correspond to an image signal having a high dot frequency as in, for example, XGA, SXGA, and EWS.

Here, in particular, in at least one of the transistors included in the buffer circuit, the direction of the channel width is in a direction (for example, in a direction parallel or nearly parallel to the scanning lines) intersecting the data lines on one of the substrates. Therefore, in the present invention, it is possible to provide a transistor having a wide channel width (that is, of a large size having a high driving performance capable of driving a sampling circuit having a larger load) in comparison with a case in which a transistor which is an element of the inverter is disposed so that its channel width is within the width (that is, the pitch of the data lines) of one data line as in a buffer circuit including an inverter in such a manner as to correspond to each latch circuit, in a conventional line sequential driving method.

Alternatively, it is possible to provide a TFT having a large channel width and having a large size which may be used for an inverter within a longitudinal region parallel to the data lines on the substrate in comparison with a case in which a TFT which is an element of the inverter is disposed so that the direction of its channel width coincides with the longitudinal direction parallel to the data lines and is within the pitch of the data lines as in a buffer circuit including an inverter, to correspond to the output of a shift register in the conventional line sequential driving method.

In one embodiment of the present invention, the channel of the transistor has a width within the pitch of the adjacent 2 to n data lines.

According to this embodiment, in the conventional line sequential driving method, a vertically elongated transistor corresponding to the pitch of the data lines is laid out on a substrate. However, in the present invention, by setting the direction of the channel width in a direction intersecting the data line while the channel width is within the total width of n data lines which are driven simultaneously and by effectively using the area on the substrate extending along its length along the scanning lines between the shift register circuit and the sampling circuit, it is possible to lay out a horizontally elongated transistor of a large size corresponding to the total width of the plural data lines on a substrate.

As a result of the above, according to the present invention, while effectively using the area on the substrate, it is possible to provide a buffer circuit including an inverter formed of a large transistor capable of driving a load even if the load in the sampling circuit is increased with an increase in the number of data lines which are driven simultaneously, and it is possible for the relevant driving circuit having saved space to perform a satisfactory driving operation even in the case of a high dot frequency.

In one embodiment of the driving circuit for an electro-optical device according to the present invention, the buffer circuit includes inverters of m (m is an integer of 2 or more) stages which are connected in series in such a manner as to correspond to each of the latch circuits.

According to this embodiment, by increasing the size of the transistor which is an element of an inverter of each stage in a stepped manner of the inverters which are of m stages, it is possible to increase a load in the sampling circuit, which can be driven by all the inverters. That is, it is possible to increase the number of sampling switches which can be driven simultaneously.

Therefore, since a relatively small transistor, which is an element of the inverter of the first stage when viewed from the side of the latch circuit, is required, the size of the transistor which is an element of the latch circuit which inputs a transfer signal to this transistor can also be required to be small. For this reason, a lower power consumption in the shift register circuit comprising plural latch circuits can be achieved.

However, if the number of stages (m) of the inverters is increased, the total of the delay time by the transistor which is an element of these inverters is also increased. Therefore, in practice, this number of stages (m) of the inverters is determined by considering the dot frequency, required specifications, image quality, and the like, so that the total of this delay time ultimately does not exert an adverse influence upon the display image.

In this embodiment, the channel width of the transistor possessed by the (i+1)-th stage counting from the side of each of the latch circuits may be set larger than the channel width of the transistor possessed by the inverter of the i-th stage.

With such a construction, since the size of the transistor which is an element of an inverter of each stage is increased in a stepped manner, it is possible to increase the load in the sampling circuit which can be driven by all the inverters, making it possible to increase the number of sampling switches which can be driven simultaneously.

In an embodiment in which this buffer circuit includes inverters of m stages, the inverters of m stages are provided in a meandering shape, with a first portion extending in a first direction intersecting the data lines from a side near the shift register circuit and a second portion extending in a direction opposite to the first direction from the first portion and may be arranged in sequence in a direction intersecting the scanning lines.

With such a construction, it is possible to take a wider channel width of the transistor, which is an element of the inverter, by an amount corresponding to the meandering. For example, if the inverters are provided in a meandering shape of a letter S, a channel width can be secured which is approximately three times wider than that in a case in which a channel width is simply taken straight in a first direction, thereby making it possible to increase the driving performance of the transistor according to an increase in the channel width.

In this case, furthermore, a power wiring extending in the first direction may be shared between the first and second portions.

With such a construction, since the power wiring extending in the first direction is shared between the first and second portions, it is possible to shorten the length in a direction (for example, in a longitudinal direction along the data lines) at right angles to the first direction in the entire buffer circuit by an amount corresponding to the width of the power wiring to be shared in comparison with a case in which the power wiring is not shared.

In another embodiment of a driving circuit for an electro-optical device in accordance with the present invention, the buffer circuit includes an inverter of one stage in such a manner as to correspond to each latch circuit, respectively.

According to this embodiment, since the inverter which is an element of the buffer circuit is of one stage, the delay time of the entire buffer circuit is completely or nearly equal to the delay time in the transistor which is an element of the relevant inverter of one stage. For this reason, a shorter delay time results in comparison with a case in which plural inverters are provided and the delay time is added in series.

In this embodiment, the inverter of one stage may comprise plural inverters which extend in directions intersecting the data lines, respectively, and which are connected in parallel in such a manner as to be arranged in sequence in directions intersecting the scanning lines.

With such a construction, since the inverter of one stage comprises plural inverters which are connected in parallel and which are arranged in sequence in directions (for example, in directions parallel to or nearly parallel to the data lines) intersecting the scanning lines, it is possible to effectively use the area on the substrate having an area corresponding to the total width of the data lines which are driven simultaneously and to lay out the relevant inverter.

In this case, furthermore, a power wiring extending in a direction intersecting the data lines may be shared between the plural inverters which are connected in parallel.

With such a construction, since a power wiring extending in a direction intersecting the data lines is shared between the plural inverters which are connected in parallel, it is possible to shorten the length in a direction (for example, in a direction parallel to or nearly parallel to the data lines) intersecting this direction in the entire buffer circuit by an amount corresponding to the width of the power wiring to be shared in comparison with a case in which the power wiring is not shared.

In yet another embodiment of a driving circuit for an electro-optical device in accordance with the present invention, the transistor comprises a complementary transistor.

According to this embodiment, the complementary transistor makes it possible to increase the input impedance of each inverter, making it possible to drive a sampling switch having a large load via the relevant complementary transistor in accordance with a transfer signal from a latch circuit having a small driving performance.

In still another embodiment of a driving circuit for an electro-optical device in accordance with the present invention, the data line driving circuit further comprises a phase adjustment circuit for limiting a signal width of the transfer signal to a predetermined value in each section between the latch circuit and the buffer circuit.

According to this embodiment, since the signal width (the time in which the signal is assumed to be at a high level) of the transfer signal is limited to a predetermined value (predetermined time width) by the phase adjustment circuit present between the latch circuit and the buffer circuit, the overlap between the transfer signals which are output almost simultaneously from the latch circuit is reduced. Consequently, crosstalk and ghost, which occur due to such overlapping, between the data lines (that is, every n data lines) which are driven almost simultaneously, can be prevented.

In still another embodiment of a driving circuit for an electro-optical device in accordance with the present invention, plural image signal lines are arranged along the scanning lines on one of the substrates, and the buffer circuit is formed in an area on the substrate between the plural image signal lines and the shift register circuit.

According to this embodiment, the sampling circuit samples an image signal supplied to the plural image signal lines in accordance with a sampling control signal. Here, since the buffer circuit is formed in an area on the substrate between the plural image signal lines and the shift register circuit, effective use of the area on the substrate can be achieved by disposing a horizontally elongated inverter in a horizontal rectangular area along the image signal lines and the scanning lines.

In still another embodiment of a driving circuit for an electro-optical device in accordance with the present invention, the image signal is subjected to n serial-to-parallel conversions, and is supplied to the sampling circuit via n image signal lines.

According to this embodiment, the image signal is subjected to n serial-to-parallel conversions, and is supplied to the sampling circuit via the n image signal lines. Therefore, even when the dot frequency is high as in, for example, XGA, SXGA, or EWS, high-quality image display is made possible by serial-to-parallel conversion even by using a sampling circuit having a relatively low sampling performance or having a relatively low performance in delay time, and the like.

An electro-optical device in accordance with the present invention comprises the above-described driving circuit for an electro-optical device of the present invention.

According to the electro-optical device in accordance with the present invention, since the electro-optical device comprises the above-described driving circuit of the present invention, it is possible to miniaturize the entire device and to increase the size of the image display area in a device of the same size, and at the same time, an electro-optical device, such as a liquid-crystal device, capable of displaying a high-quality image, can be realized.

In one embodiment of an electro-optical device in accordance with the present invention, on one of the substrates, plural pixel electrodes disposed in a matrix, and plural transistors for driving the plural pixel electrodes, respectively, are further provided, and the plural data lines and the plural scanning lines are connected to the plural transistors, respectively.

According to this embodiment, an electro-optical device, such as a liquid-crystal device, can be realized using the commonly-termed "TFT active-matrix driving method", which is capable of displaying a high-quality image.

In order to solve the above-described problems, an electronic apparatus of the present invention comprises the above-described electro-optical device of the present invention.

According to this embodiment, it is possible to provide an electronic apparatus comprising an electro-optical device capable of displaying a high-quality image.

Such an operation and the other advantages of the present invention will become apparent from the embodiments described below.

DETAILED DESCRIPTION OF PREFERRED EMBODIMENTS

The embodiments of the present invention are described below with reference to the drawings.

Referring to FIGS. 1 to 8, a description is given of the construction and operation of a first embodiment of a liquid-crystal device which is an example of an electro-optical device.according to the present invention.

Figure 1:
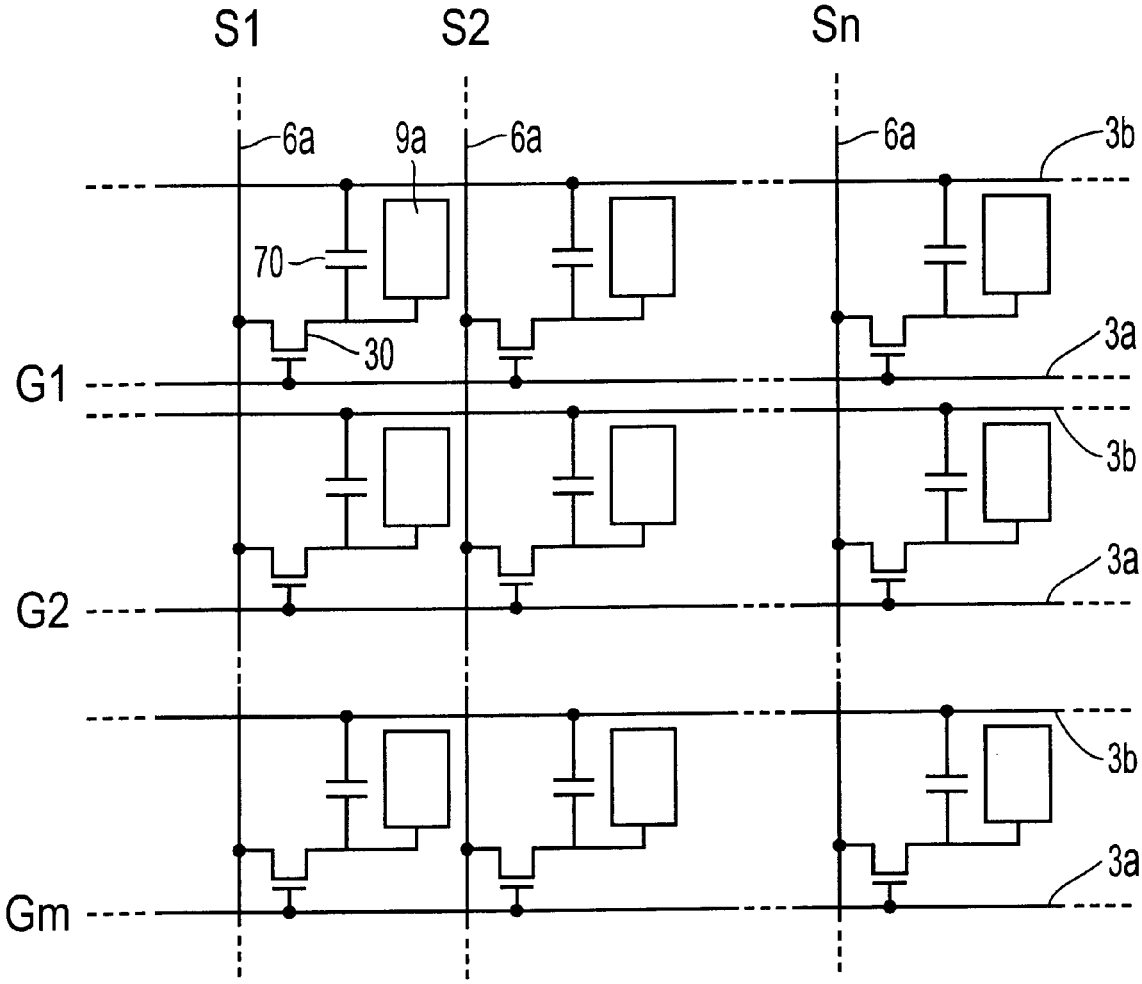
FIG. 1 is a block diagram of an equivalent circuit of various elements, wirings, and the like, provided with plural pixels in a matrix which form an image display area in a first embodiment of a liquid-crystal device.

First, the circuit construction of the liquid-crystal device is described with reference to the block diagram of FIG. 1. FIG. 1 is an equivalent circuit diagram of various elements, wirings, and the like, in plural pixels formed in a matrix which form an image display area of the liquid-crystal device.

Referring to FIG. 1, for plural pixels formed in a matrix which form an image display area of the liquid-crystal device according to this embodiment, plural TFTs 30 for controlling pixel electrodes 9*a* are formed in a matrix, and a data line 6*a* to which an image signal is supplied is electrically connected to the source of the corresponding TFT 30.

In this embodiment, in particular, the construction is formed in such a way that image signals S1, S2, . . . , Sn which are to be written into the data lines 6*a*, are subjected to n (n is an integer of 2 or more) serial-to-parallel conversions in advance by a serial-to-parallel conversion circuit within an image signal processing circuit for supplying the image signals S1, S2, . . . , Sn to the target liquid-crystal device, and the serial-to-parallel converted image signals are supplied simultaneously to each group formed of n adjacent data lines 6*a*. Regarding the number of serial-to-parallel conversions, generally, if the dot frequency is relatively low or if the sampling performance in the sampling circuit (to be described later) is relatively high, the number may be set to be small as, for example, 3 serial-to-parallel conversions or 6 serial-to-parallel conversions. In contrast, if the dot frequency is relatively high or if the sampling performance is relatively low, the number may be set to be large as, for example, 12 serial-to-parallel conversions or 24 serial-to-parallel conversions. For this number of serial-to-parallel conversions, because a color image signal is formed of signals for three colors (red, blue, yellow), a multiple of 3 is preferable for simplifying control and circuits when producing video display, such as NTSC display, or PAL display. Also, in the case of high dot frequencies, as in an XGA method, an SXGA method, or an EWS method, in recent years, in view of the existing TFT manufacturing technology, it is preferable that the number of serial-to-parallel conversions be set to be large, as, for example, 12 serial-to-parallel conversions, or 24 serial-to-parallel conversions.

Also, the scanning lines 3*a* are electrically connected to the gates of the TFTs 30 so that scanning signals G1, G2, . . . , Gm are applied in a pulse form to the scanning lines 3*a* in this sequence based on the line sequence at a predetermined timing. The pixel electrodes 9*a* are electrically connected to the drains of the TFTs 30 so that by closing the switch of the TFT 30 which is a switching element for a predetermined period of time, the image signals S1, S2, . . . , Sn which are supplied from the data lines 6*a* are written at a predetermined timing. The image signals S1, S2, . . . , Sn of a predetermined level which are written into the liquid crystal via the pixel electrodes 9*a* are held for a predetermined period of time in a section adjoining the opposing electrodes (to be described later) formed in an opposing substrate (to be described later). The liquid crystal, as a result of its crystal orientation and the order of the molecule aggregation being varied according to the level of the voltage to be applied, modulates light, making gray scale display possible. In the case of the normally white mode, incident light cannot pass through this liquid-crystal portion according to the applied voltage, and in the case of the normally black mode, incident light can pass through this liquid-crystal portion according to the applied voltage, and as a whole, light having a contrast in response to the image signal being emitted from the liquid-crystal device. Here, in order to prevent the held image signal from leaking, a storage capacitor 70 is added in parallel to a liquid-crystal capacitor formed between the pixel electrode 9*a* and the opposing electrode. For example, the voltage of the pixel electrode 9*a* is held by the storage capacitor 70 for a time longer by a factor of 3 than the time over which the source voltage is applied. As a result, the holding characteristics are further improved, and a liquid-crystal device having a high contrast ratio can be realized.

Figure 2:
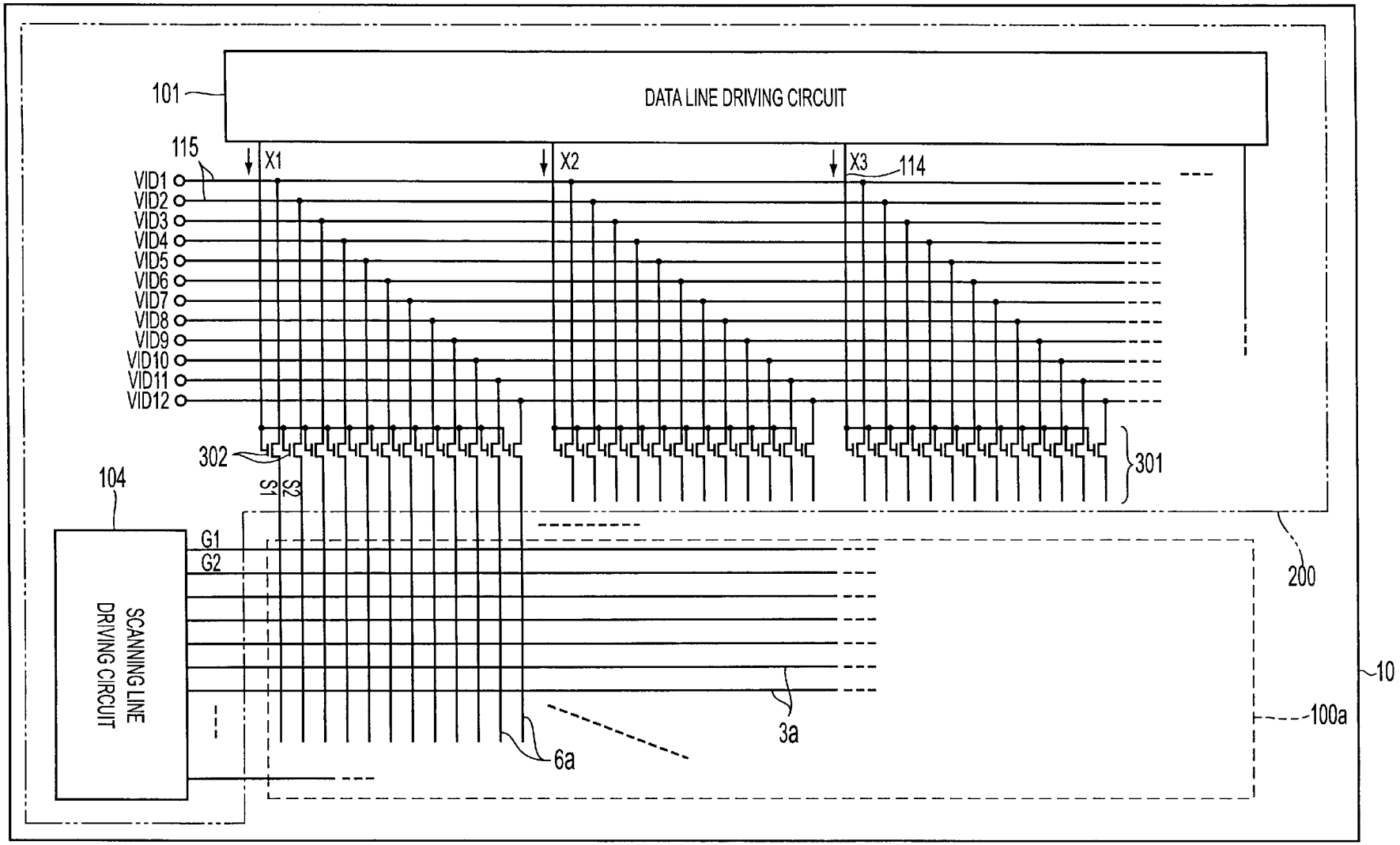
FIG. 2 is a block diagram showing pixel sections and driving circuits provided on a TFT array substrate in the first embodiment.

Next, referring to FIG. 2, a driving circuit for a liquid-crystal device according to this embodiment is described. FIG. 2 is a block diagram showing an image display section which is provided with scanning lines, data lines, and the like, and driving circuits provided on a substrate of a liquid-crystal device, in the periphery of the image display section.

In FIG. 2, an image display section 100*a* provided with the scanning lines 3*a*, the data lines 6*a*, and the like, described in FIG. 1, is provided in nearly the central portion of a TFT array substrate 10 of a liquid-crystal device, and a driving circuit 200 comprising a data line driving circuit 101, a scanning line driving circuit 104, and a sampling circuit 301 is provided in the periphery of the image display section 100*a*. That is, the liquid-crystal device of this embodiment is constructed as a liquid-crystal device for a TFT active-matrix driving method for a driving circuit built-in type in which the driving circuit 200 is formed on the TFT array substrate 10.

The scanning line driving circuit 104 supplies scanning signals G1, G2, . . . , Gm in a pulse form based on the line sequence to the scanning lines 3*a* at a predetermined timing in accordance with a vertical synchronization signal for the image signals supplied from an external image signal processing circuit.

The data line driving circuit 101 supplies sampling control signals X1, X2, . . . , Xn to the control terminal of each sampling switch 302, which is a constituent of the sampling circuit 301, via a sampling control signal line 114 in synchronization with the timing the scanning line driving circuit 104 sends the scanning signals G1, G2, . . . , Gm to the scanning lines 3*a*. The sampling circuit 301 samples the image signal supplied to image signal lines 115 in accordance with these sampling control signals X1, X2, . . . , Xn and supplies the image signals to the data lines 6*a*. In this embodiment, in particular, the sampling switches 302 which are connected to the 12 adjacent data lines corresponding to 12 serial-to-parallel converted image signals VID1 to VID12 are turned on simultaneously in accordance with the same sampling control signal, and one corresponding to each of the image signals VID1 to VID12 is simultaneously supplied to these 12 data lines 6*a*.

Figure 3:
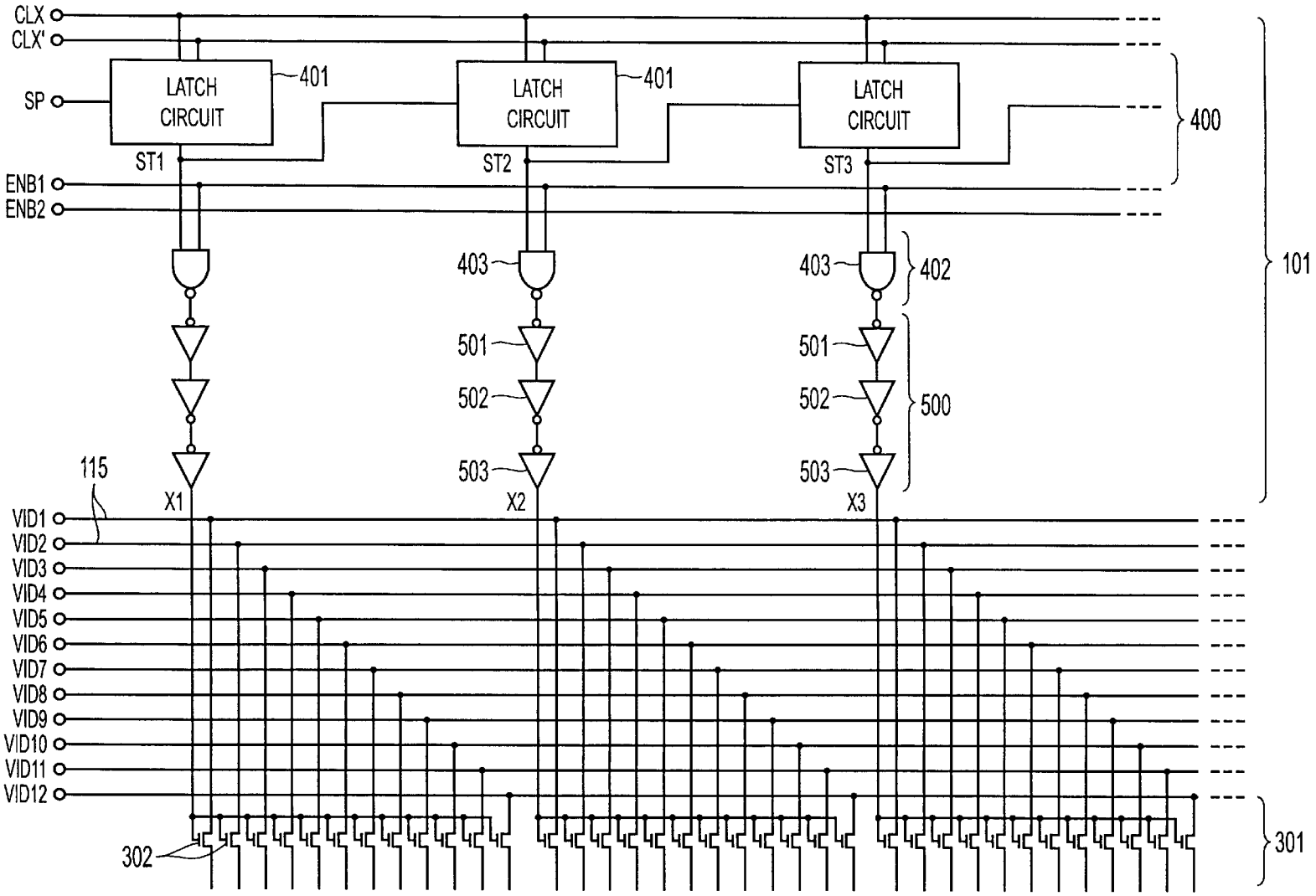
FIG. 3 is a block diagram showing a detailed construction of a data line driving circuit and a sampling circuit in the first embodiment.
Figure 4:
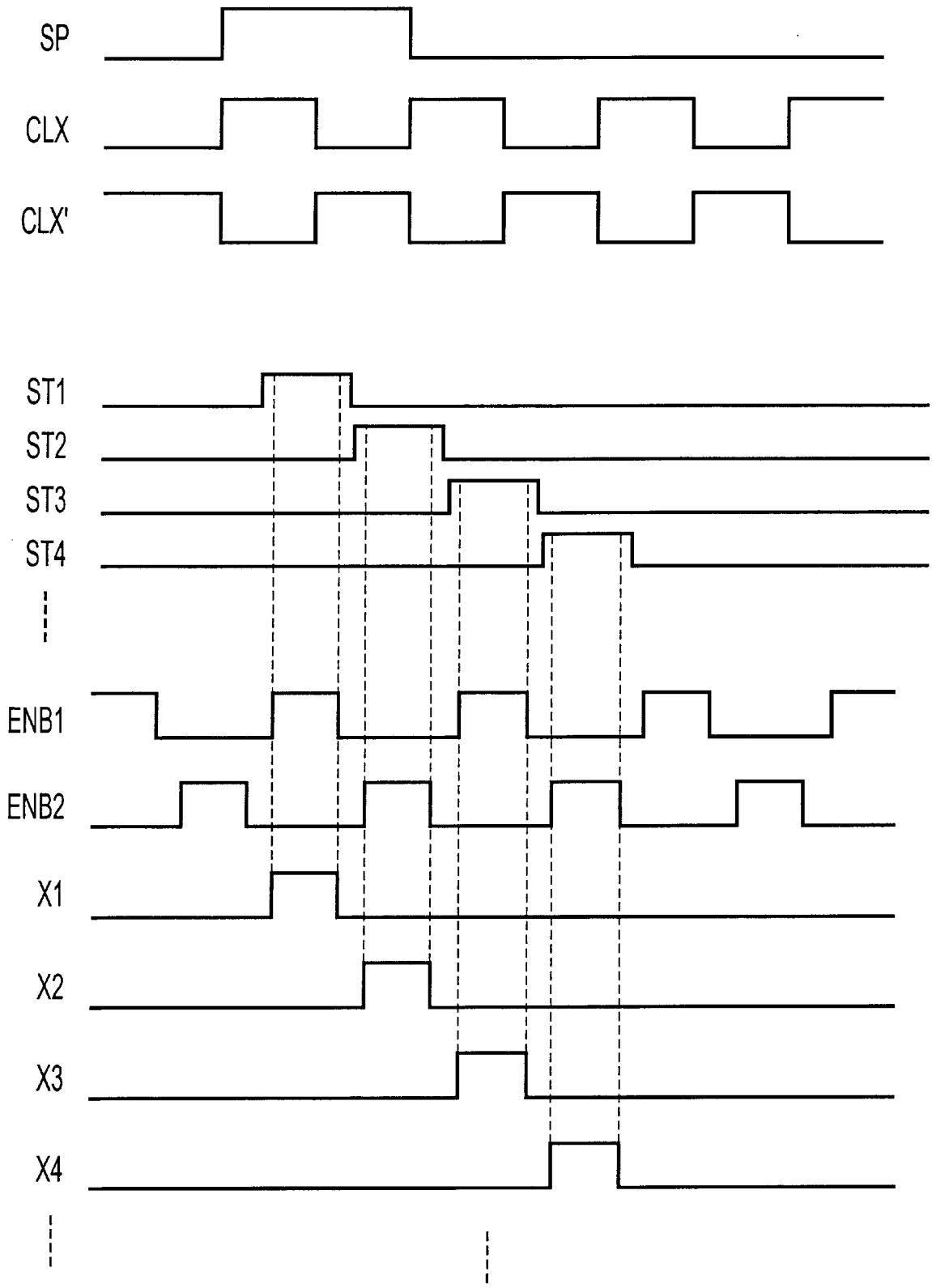
FIG. 4 is a timing chart of various signals within the data line driving circuit in the first embodiment.

Next, referring to FIGS. 3 and 4, a detailed construction of the data line driving circuit 101 and the sampling circuit 301, together with their operation, is described. FIG. 3 is a block diagram showing a latch circuit 401, and the like, which is an element of the data line driving circuit 101, together with the sampling circuit 301, and the like. FIG. 4 is a timing chart of various signals within the data line driving circuit 101.

In FIG. 3, the data line driving circuit 101 includes a shift register circuit 400 for outputting a transfer signal in sequence, and a buffer circuit 500 for shaping the waveform of the transfer signal which is output in sequence. The shift register circuit 400 includes a latch circuit 401 formed of a delay-type flip-flop circuit of plural stages which are connected in series. The data line driving circuit 101 further includes a phase adjustment circuit 402 formed of, for example, plural NAND circuits 403, and the like, which are connected to each latch circuit 401. The buffer circuit 500 includes inverters 501, 502, and 503 of three stages which are connected in series to each group of sampling switches 302 which are driven simultaneously.

As shown in FIGS. 3 and 4, the shift register circuit 400 is constructed as described below.

More specifically, when a start pulse sp synchronized with the horizontal synchronization signal of the image signals VID1 to VID12 is input from an external image signal processing circuit, first, the latch circuit 401 of the left end stage starts a transfer operation in accordance with an X-side reference clock signal clx (and its inverted clock signal clx'), outputs a transfer signal ST1 to the corresponding NAND circuit 403 in the phase adjustment circuit 402, and outputs the transfer signal ST1 to the latch circuit 401 of the next stage. Then, a latch circuit 401 of the next stage starts a transfer operation in accordance with the X-side reference clock signal clx (and its inverted clock signal clx'), outputs a transfer signal ST2 which rises at the rising timing of the transfer signal ST1 to the corresponding NAND circuit 403 in the phase adjustment circuit 402, and outputs the transfer signal ST2 to the latch circuit 401 of the next stage. Then, hereafter, the same transfer operation is performed in sequence by the latch circuit 401 of each stage so that the transfer signals ST1, ST2, . . . , STn are thoroughly output to the phase adjustment circuit 402 in one horizontal scanning period.

Also, the phase adjustment circuit 402 computes the NAND of a transfer signal ST 2i-1 (i is an integer) input from the corresponding latch circuit 401 and a phase adjustment signal enb1 by each odd-numbered NAND circuit 403 counting from the left, and outputs it to the buffer circuit 500. Also, the phase adjustment circuit 402 computes the NAND of a transfer signal ST 2i (i is an integer) input from the corresponding latch circuit 401 and a phase adjustment signal enb2 by each even-numbered NAND circuit 403 counting from the left, and outputs it to the buffer circuit 500.

The buffer circuit 500 includes inverters 501, 502, and 503 of three stages which are connected in series for each output terminal of each phase adjustment circuit 402. Then, by increasing the size of the TFT which is an element of the inverters 501, 502, and 503 in a stepped manner as will be described later, a load in the sampling circuit 301, which can be driven by all the inverters, is increased, and the number of sampling switches 302 which can be driven simultaneously is increased (see FIG. 4).

In a manner as described above, the pulse width of the transfer signals ST1, ST2, . . . , STn is limited by the phase adjustment circuit 402, and furthermore, the waveform is shaped by the buffer circuit 500, and these signals are output as sampling control signals X1, X2, . . . , Xn to the sampling circuit 301.

In this embodiment, in particular, due to the limitation of the pulse width by the phase adjustment circuit 402, for the almost simultaneous sampling control signals X1, X2, . . . , Xn, there are brief time intervals between the signal pulses (see FIG. 4), making it possible to inhibit or prevent ghost and crosstalk, resulting from the overlap of these signal pulses, between the data lines 6*a* which are driven almost simultaneously. Also, since the driving performance in the output of the buffer circuit 500 is set far larger than the driving performance in the output of the latch circuit 401 or the phase adjustment circuit 402, the sampling control signals X1, X2, . . . , Xn make it possible to satisfactorily drive a plurality of sampling switches 302 simultaneously, whose load is far larger than that of one sampling switch 302.

Figure 5:
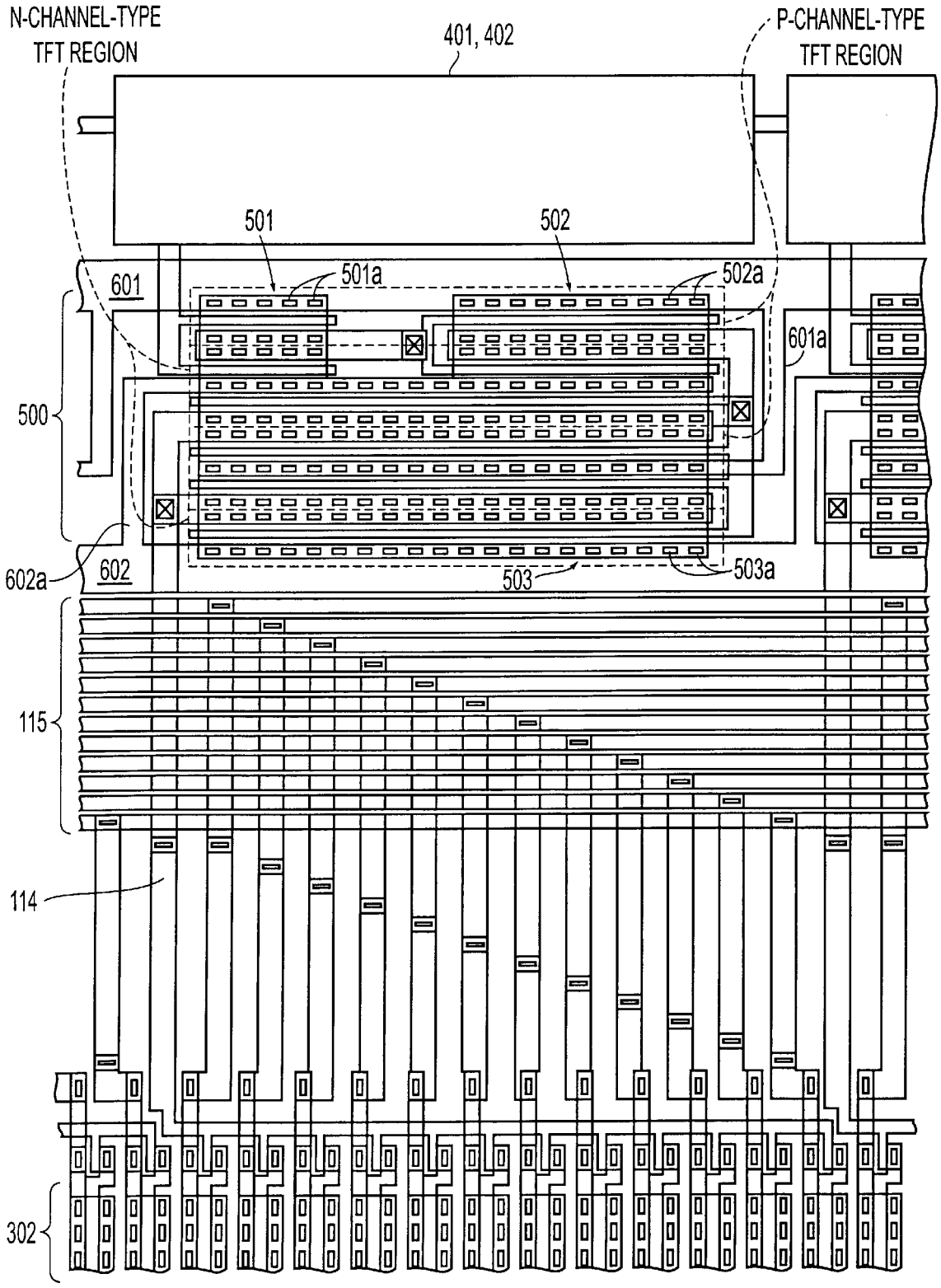
FIG. 5 is an enlarged plan view showing a buffer circuit included in the data line driving circuit, together with wiring in the periphery thereof, in the first embodiment.
Figure 6:
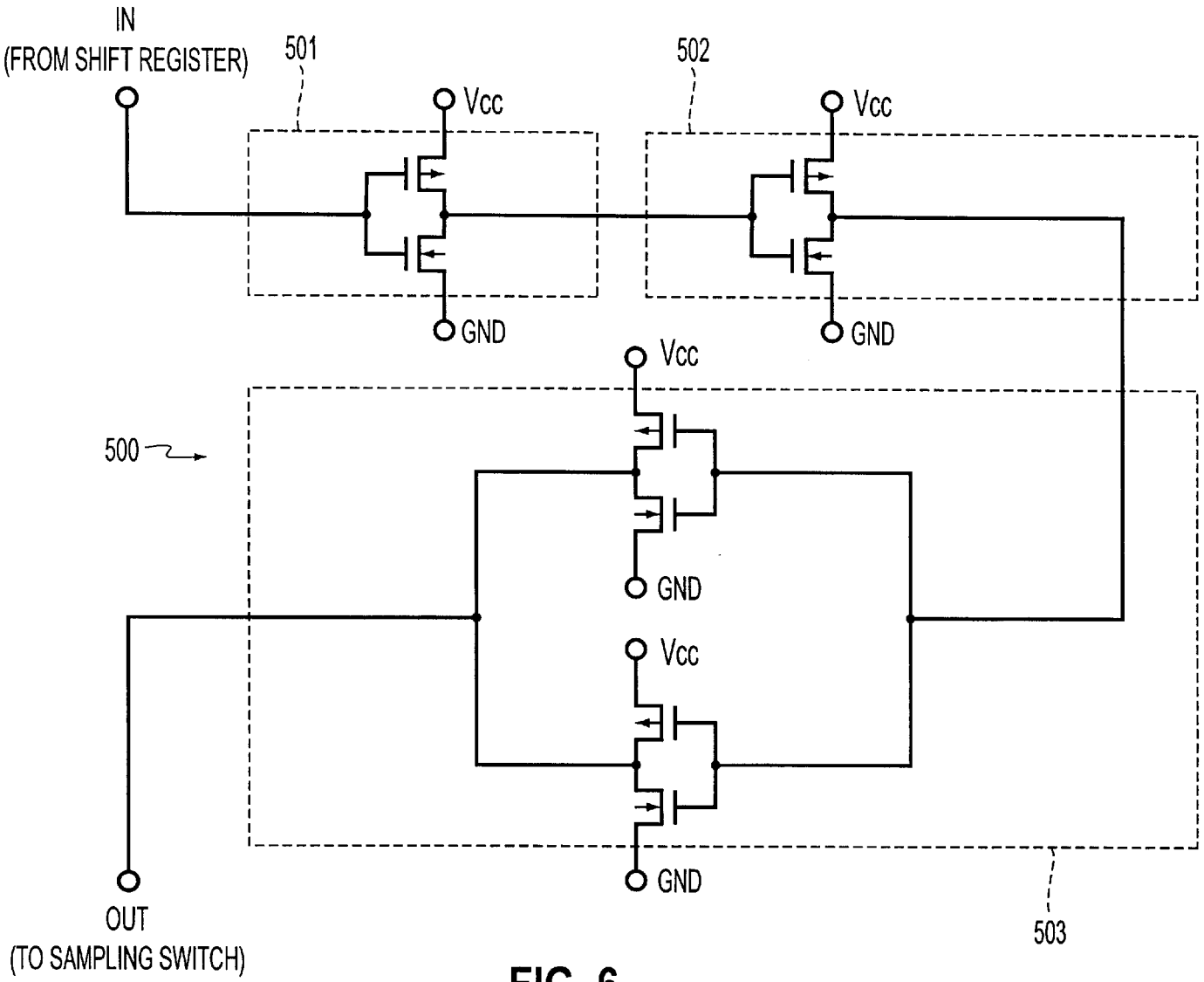
FIG. 6 is a circuit diagram of the buffer circuit shown in FIG. 5.

Next, referring to FIGS. 5 and 6, a description is given of the specific construction of TFTs which are elements of the inverters 501, 502, and 503 included in the buffer circuit 500. FIG. 5 is an enlarged plan view showing the buffer circuit 500, the image signal lines 115, the elements formed on the TFT array substrate 10 in the vicinity thereof, and the wiring layout. An example is shown in which image signals which are subjected to 12 serial-to-parallel conversions are supplied by 12 image signal lines 115, and the 12 sampling switches 302 are driven simultaneously by the same sampling control signals X1, X2, . . . FIG. 6 is a circuit diagram showing the buffer circuit 500 shown in FIG. 5 in such a manner as to correspond to its layout.

In FIG. 5, a high-voltage wiring 601 and a low-voltage wiring 602 for driving the inverters 501, 502, and 503 are wired in the buffer circuit 500.

First, the size of the complementary TFT, which is an element of an inverter 501 of the first stage when viewed from the side of the latch circuit 401, is relatively small. That is, the complementary TFT has a channel width such that five contact holes 501 a are arrayed in the horizontal direction in the figure, and this corresponds to approximately 2.5 times the pitch of the data lines 6*a*. Therefore, the size of the TFT which is an element of the latch circuit 401 which inputs the transfer signals ST1, ST2, . . . to this complementary TFT, having a relatively high input impedance, is also required to be small. For this reason, a lower power consumption in the shift register circuit 400, in which the amount of power consumed is often a problem, comprising a plurality of latch circuits 401, can be achieved. Also, in a small complementary TFT which is an element of the inverter 501 of the first stage in this manner, a wiring 404 for a transfer signal supplied from the latch circuit 401 via the phase adjustment circuit 402 is extended and is formed as a gate electrode, and a part of the high-voltage wiring 601, and an extension wiring 602*a* of the low-voltage (ground) wiring 602 are the source or the drain electrode on the input side.

As shown in FIGS. 5 and 6, the source or the drain electrode on the output side of the complementary TFT which is an element of the inverter 501 of the first stage is extended and is formed as the gate electrode of the complementary TFT of a inverter 502 of the second stage.

The size of the complementary TFT, which is an element of the inverter 502 of the second stage, is larger than that of the inverter 501. That is, the complementary TFT has a channel width such that ten contact holes 502*a* are arrayed in the horizontal direction in the figure, and this corresponds to approximately 5 times the pitch of the data lines 6*a*.

In this embodiment, in particular, the buffer circuit 500 comprising inverters of a total of three stages is provided in a meandering shape on the TFT array substrate 10, and whereas the inverters 501 and 502 of the first and second stages extend to the right in the figure, the inverter 503 of the third stage extends to the left in the figure. Furthermore, as shown in FIG. 5, the inverter 503 of the third stage comprises two parallel-connected inverters. The source or drain electrode on the output side of these two inverters is connected to the sampling control signal line 114. That is, the output voltage of the inverter 503 of the third stage is a sampling control signal (X1, X2, . . . ) from the buffer circuit 500.

The size of the complementary TFT which is an element of the inverter 503 of the third stage is larger than that of the inverter 502. That is, the complementary TFT has a channel width such that 20 contact holes 503*a* are arrayed in the horizontal direction in the figure, and this corresponds to approximately 10 times the pitch of the data lines 6*a*. In FIG. 6, a voltage Vcc indicates a high voltage (for example, 5 V, 15 V, and the like) supplied from the high-voltage wiring 601, and a voltage Gnd indicates a low voltage (for example, a grounded voltage) supplied from the low-voltage wiring 602.

Figure 7A:
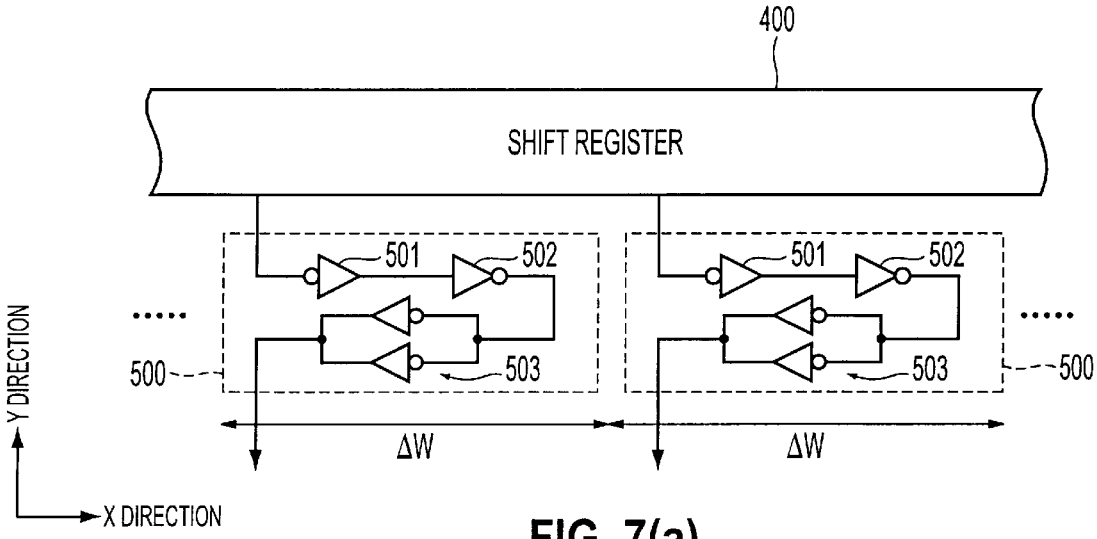
FIGS. 7(*a*), 7(*b*), and 7(*c*) are block diagrams showing examples of various constructions of inverters in the buffer circuit in the first embodiment.
Figure 7B:
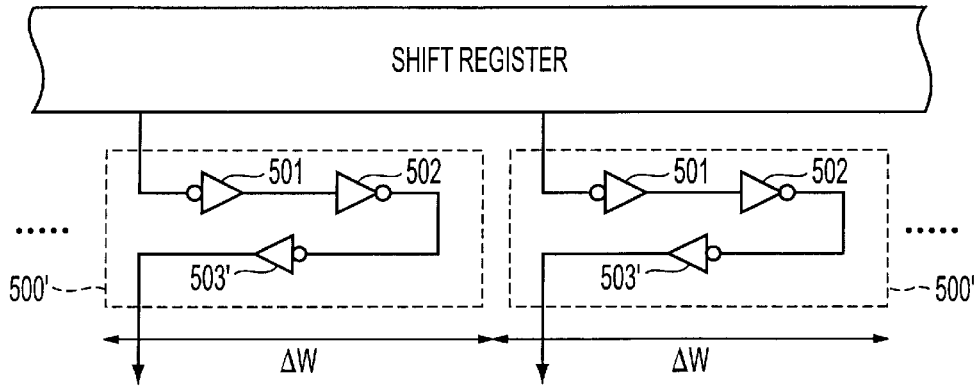
Figure 7C:
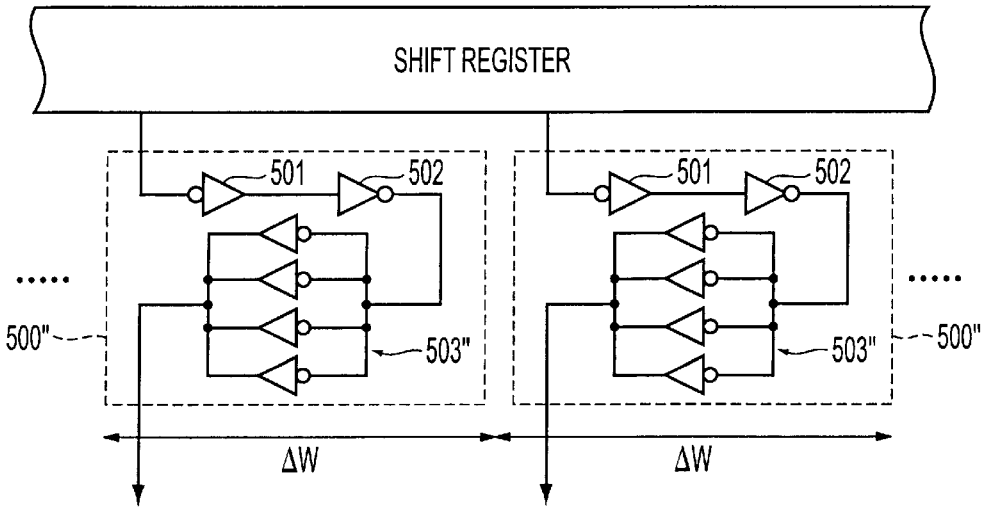

Here, the method for arranging the inverters 501, 502, and 503 of the three stages described in the foregoing, and the method for arranging a plurality of buffer circuits 500 are shown in FIG. 7(*a*).

As is clear from FIG. 7(*a*) and FIG. 6, in this embodiment, within each buffer circuit 500, the inverters 501, 502, and 503 of the three stages are disposed in a meandering shape, and the inverter 503 of the third stage comprises two parallel-connected inverters. Then, planar layout is made so that the width of each buffer circuit 500 in the X direction coincides with the total width ($\Delta W$) of 12 data lines 6*a* which are driven simultaneously (see FIG. 7(*a*)).

It is possible to take a wider channel width of the TFTs which are constituents of the inverters 501, 502, and 503 by an amount corresponding to the meandering of the buffer circuit 500, making it possible to increase the driving performance of the TFTs in the buffer circuit 500 in response to this increase in the channel width.

As described by referring to FIG. 5 to FIG. 7(*a*) in the foregoing, in this embodiment, in particular, in each TFT which is an element of the inverters 501, 502, and 503, the direction of the channel width is in an X direction on the TFT array substrate 10, and the TFT has a channel width equal to several times to approximately 10 times the pitch of the data lines 6*a*. Consequently, in comparison with a case in which TFTs, which are elements of the inverter, are disposed so that their channel width is within the pitch of the data lines, as in a buffer circuit including inverters in such a manner as to correspond to each latch circuit in the conventional line sequential driving method, TFTs having a wider channel width and having a larger size can be disposed for use with inverters. Alternatively, in comparison with a case in which TFTs which are elements of the inverter are disposed, so that its channel width is within the pitch of the data lines in a layout in which the direction of their channel width coincides with the Y direction as in a buffer circuit including inverters in such a manner as to correspond to each latch circuit in the conventional line sequential driving method, it is possible to provide TFTs having a wide channel width and having a large size for use with inverters within an area on the substrate, which is limited in the Y direction.

As a result of the above, according to this embodiment, while effectively using the area on the substrate, even if a load in the sampling switch 302 is increased in response to an increase in the number of data lines 6*a* which are driven simultaneously, it is possible to provide the buffer circuit 500 comprising the inverters 501, 502, and 503 formed of large TFTs capable of driving the load, making it possible to perform a satisfactory driving operation even in the case of a high dot frequency by the space-saved data line driving circuit 101.

In addition, in this embodiment, in particular, since the channel width of the TFTs which are elements of the inverters 501, 502, and 503 is increased toward the third stage from the first stage, that is, since the size of the TFTs is increased in a stepped manner, the load in the sampling circuit 301, which can be driven by all the inverters, can be increased efficiently, making it possible to efficiently increase the number of sampling switches 302 which can be driven simultaneously. In particular, since the channel width of each TFT which is an element of the inverters 501, 502, and 503 is increased approximately two to four times for each stage, it is possible to drive the sampling circuit 301 having a load of a magnitude of approximately $2^3$ to $4^3$=8 to 64 at a total of three stages in comparison with a case in which there is no buffer circuit. Also, in this embodiment, in particular, since each TFT which is an element of the inverters 501, 502, and 503 is a complementary TFT, if the channel width is set to be e times as large (approximately 2.73 times) for each stage, it is also possible to efficiently increase the driving performance in accordance with the commonly-termed "theorem of e times".

Furthermore, in this embodiment, in particular, as shown in FIG. 5, the extension wiring 602*a* of the low-voltage wiring 602 is shared between each TFT which is an element of the inverters 501 and 502 and the upper TFT which is an element of the inverter 503. In addition, the extension wiring 601*a* of the high-voltage wiring 601 is shared between the upper TFT which is an element of the inverter 503 and the lower TFT. Consequently, the length of the entire buffer circuit 500 in the Y direction can be shortened by an amount corresponding to one extension wiring 601*a* and by an amount corresponding to one extension wiring 602*a* in comparison with a case in which these wirings are not shared. For example, if the width of the power wiring is 10 $\mu$m, a shortening of 20 $\mu$m in the Y direction is possible for a total of two wirings.

In the first embodiment described above, the arrangement of the inverter 501 of three stages within each buffer circuit 500 and the arrangement of each buffer circuit 500 are as shown in FIG. 7(*a*). In addition, for example, these arrangements may be as shown in FIGS. 7(*b*) or 7(*c*). That is, as shown in FIG. 7(*b*), each buffer circuit 500' may be such that an inverter 503' of the third stage may comprise a single inverter. Alternatively, as shown in FIG. 7(*c*), each buffer circuit 500" may be such that an inverter 503" of the third stage may comprise three or more parallel-connected inverters 503". Since the driving performance of the inverter 503 of the third stage is a performance for driving the sampling circuit 301 as the buffer circuit 500, the capability of adjusting the size of the TFT which is an element of the inverter 503 of the third stage (the final stage) is very advantageous in designing the device.

Figure 8A:
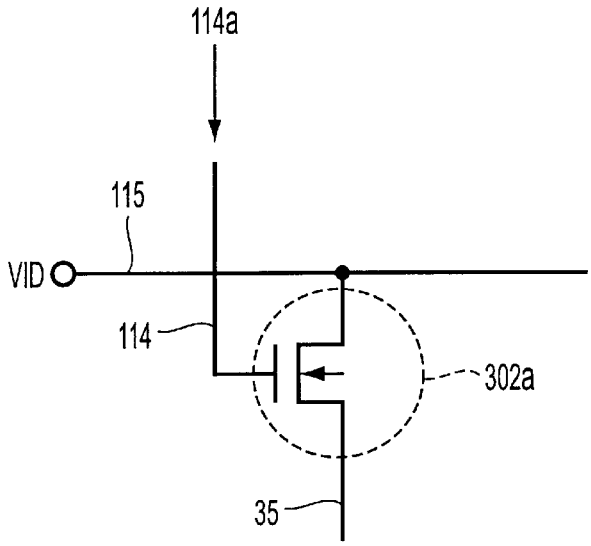
FIGS. 8(*a*), 8(*b*), and 8(*c*) are circuit diagrams showing examples of various constructions of sampling switches included in the sampling circuit in the first embodiment.
Figure 8B:
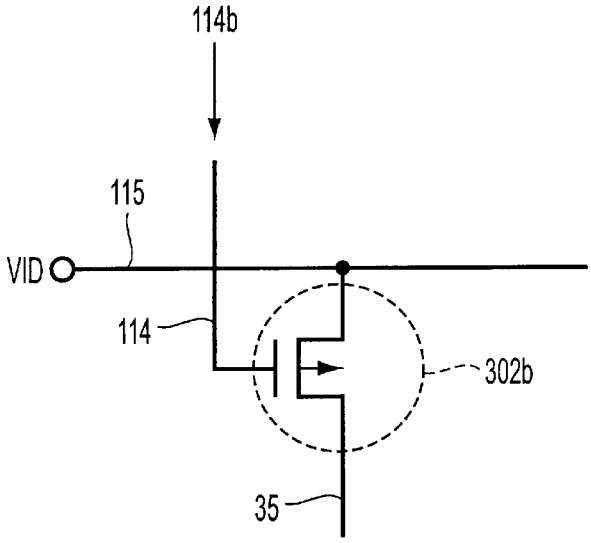
Figure 8C:
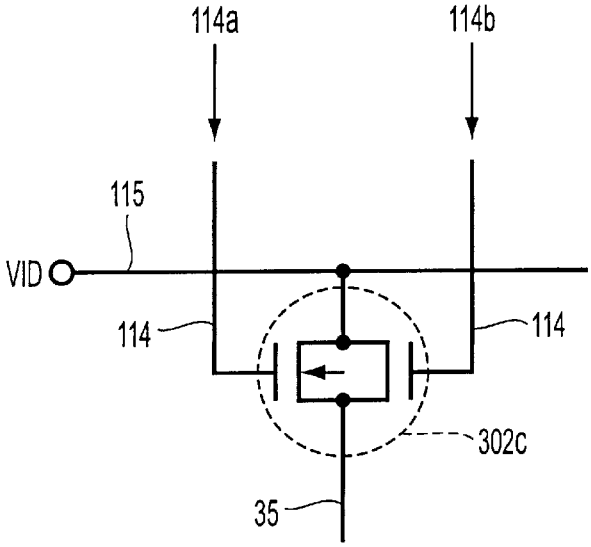

A specific example of the construction of the sampling switch 302 which is an element of the sampling circuit 301 in this embodiment includes that shown in the circuit diagram of FIG. 8.

More specifically, as shown in FIG. 8(*a*), the TFT of the sampling circuit 301 may be an N-channel-type TFT 302*a*; as shown in FIG. 8(*b*), it may be a P-channel-type TFT 302*b*; and as shown in FIG. 8(*c*), it may be a complementary TFT 302*c*. In FIGS. 8(*a*) to 8(*c*), an image signal VID which is input via the image signal lines 115 shown in FIG. 2 is input as a source voltage to each of the TFTs 302*a* to 302*c*. Sampling control signals 114*a* and 114*b* which are input from the data line driving circuit 101 similarly shown in FIG. 2 via the sampling control signal line 114 are input as a gate voltage to each of the TFTs 302*a* to 302*c*. Also, the sampling control signal 114*a* which is applied as a gate voltage to the N-channel-type TFT 302*a* and the sampling control signal 114*b* which is applied as a gate voltage to the P-channel-type TFT 302*b* are mutually inverted signals. Therefore, when the sampling circuit 301 is to be formed of the complementary TFT 302*c*, at least two sampling control signal lines 114 for the sampling control signals 114*a* and 114*b* are required. Also, each sampling switch 302 which is an element of the sampling circuit 301 is preferably formed of an N-channel-type TFT, a P-channel-type TFT, a complementary TFT, and the like, which can be manufactured by the same manufacturing process as that of the TFTs 30 in the pixel sections from the viewpoint of manufacturing efficiency.

As has been described in detail up to this point, according to the first embodiment, since the buffer circuit 500 is laid out so that the area on the TFT array substrate 10 is efficiently used, the overall liquid-crystal device can be miniaturized, the image display area in a device of the same size can be increased, and at the same time, a liquid-crystal device which is capable of coping with a high dot frequency and which is capable of displaying a high-quality image can be realized.

Figure 9:
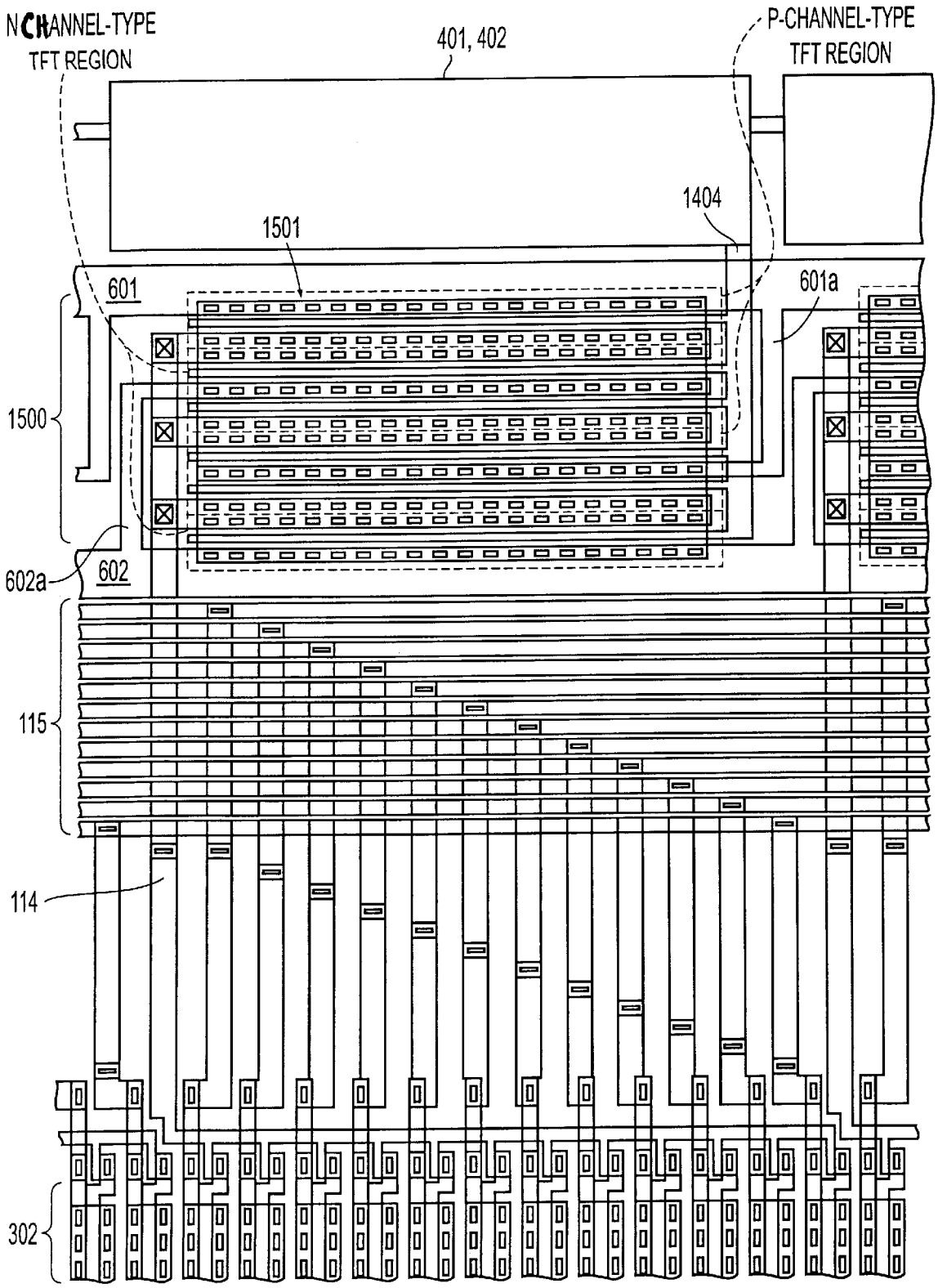
FIG. 9 is an enlarged plan view showing a buffer circuit included in a data line driving circuit, together with wiring in the periphery thereof, in a second embodiment of the present invention.
Figure 10:
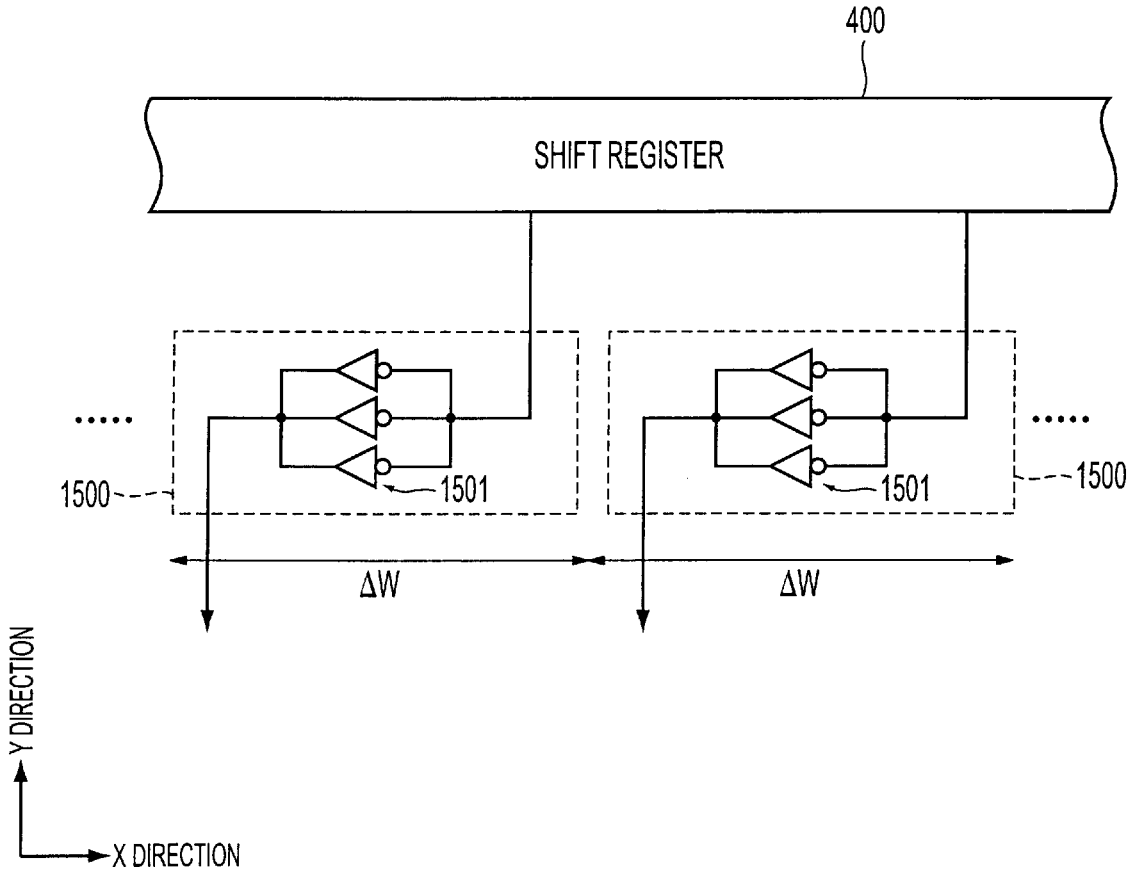
FIG. 10 is a block diagram showing an inverter in a buffer circuit in the second embodiment.

A second embodiment of a liquid-crystal device, which is an example of an electro-optical device according to the present invention, is described with reference to FIGS. 9 and 10. FIG. 9 is an enlarged plan view showing a buffer circuit and image signal lines, and elements formed on a TFT array substrate 10 in the vicinity thereof, and the wiring layout. FIG. 10 is a block diagram showing a method for arranging plural inverters and a method for arranging plural buffer circuits 500. Components in FIGS. 9 and 10 which are the same as those of the first embodiment shown in FIGS. 5 and 7 are given the same reference numerals, and accordingly, descriptions thereof have been omitted.

In the liquid-crystal device of the second embodiment, the construction of the buffer circuit differs from the case of the first embodiment, and the remaining construction is the same, and accordingly, the buffer circuit is described below.

In FIGS. 9 and 10, in the second embodiment, a buffer circuit 1500 includes an inverter 1501 of one stage in such a manner as to correspond to each latch circuit 401. Then, this inverter 1501 of one stage includes plural inverters which extend in the X direction, respectively, and which are connected in parallel in such a manner as to be arranged sequentially in the Y direction. More specifically, a wiring 1404 for a transfer signal which is input from the latch circuit 401 via the phase adjustment circuit 402 is extended and is formed as a gate electrode of a complementary TFT which is an element of each of three parallel-connected inverters, the direction of the channel width of the complementary TFT coinciding with the X direction, and the source or the drain on the output side of these complementary TFTs is connected to the sampling control signal line 114.

According to the second embodiment, since the inverter 1501 of one stage includes plural inverters which are connected in parallel and which are arranged in sequence in the Y direction, by efficiently using an area on the substrate having an area corresponding to the total width ΔW of 12 data lines 6*a* which are driven simultaneously (see FIG. 10), the relevant inverter 1501 may be laid out. In addition, since the inverter 1501 which is an element of the buffer circuit 1500 is of one stage, the delay time of the entire buffer circuit 1500 is completely or nearly equal to the delay time of the TFT which is an element of the relevant inverter 1501 of one stage. For this reason, a shorter delay time results in comparison with a case in which the inverters 501, 502, and 503 have plural stages and the delay time is added in series as in the first embodiment.

However, in this case, a driving performance which is capable of withstanding the load of the relevant inverter 1501 of one stage is required in the latch circuit 401 and the phase adjustment circuit 402 which are positioned in a stage preceding thereto.

Also in the second embodiment, in a manner similar to the case of the first embodiment shown in FIG. 5, as shown in FIG. 9, extension wirings 601*a* and 602*a* of voltage wirings 601 and 602 extending in the X direction are shared between plural parallel-connected inverters. Consequently, the length of the entire buffer circuit 1500 in the Y direction can be shortened by an amount corresponding to two voltage wirings (for example, 10 μm×2=20 μm) in comparison with a case in which these wirings are not shared.

Figure 11:
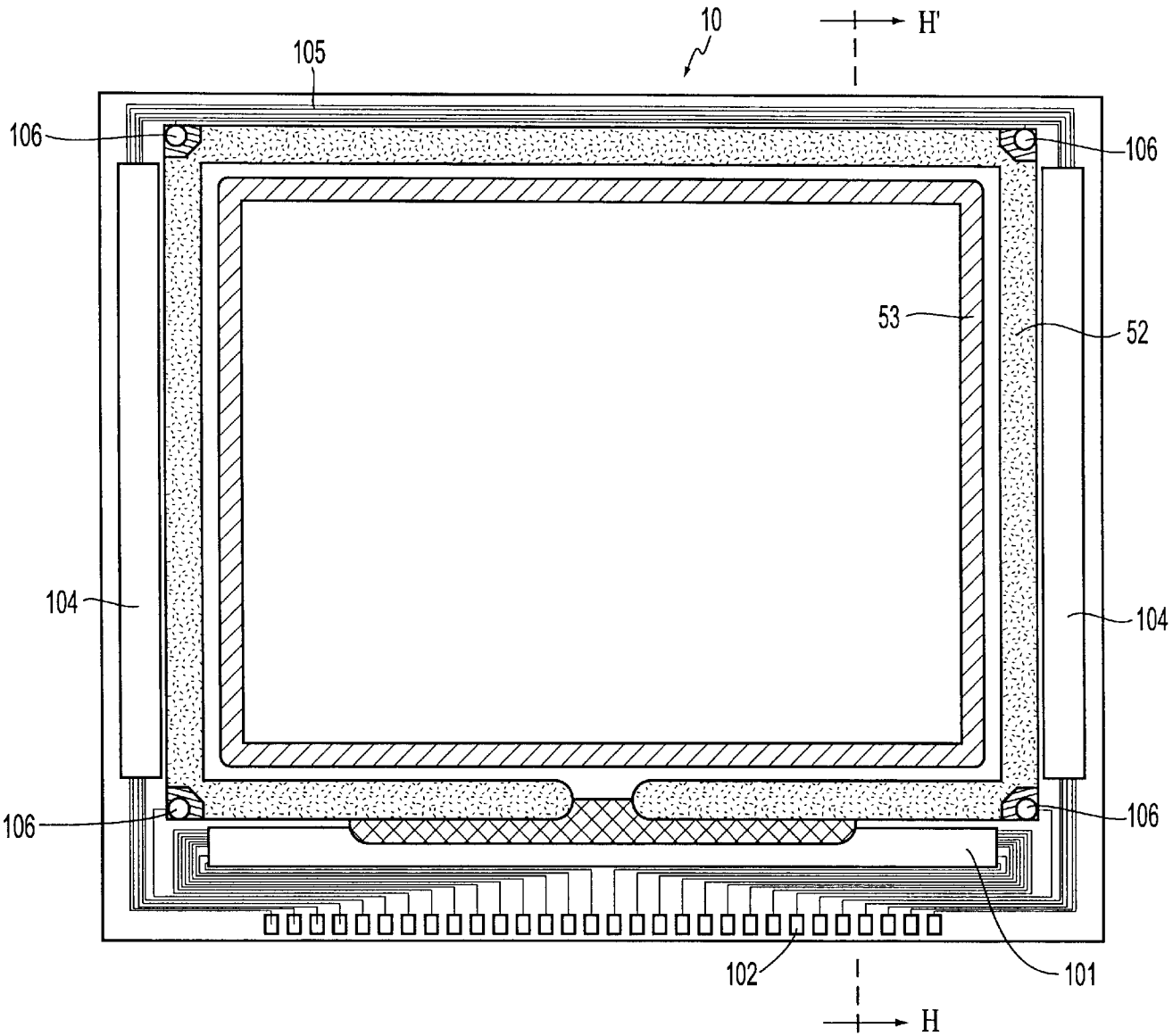
FIG. 11 is a plan view in which a TFT array substrate, together with each component formed thereon, is viewed from the side of an opposing substrate in each embodiment of a liquid-crystal device.
Figure 12:
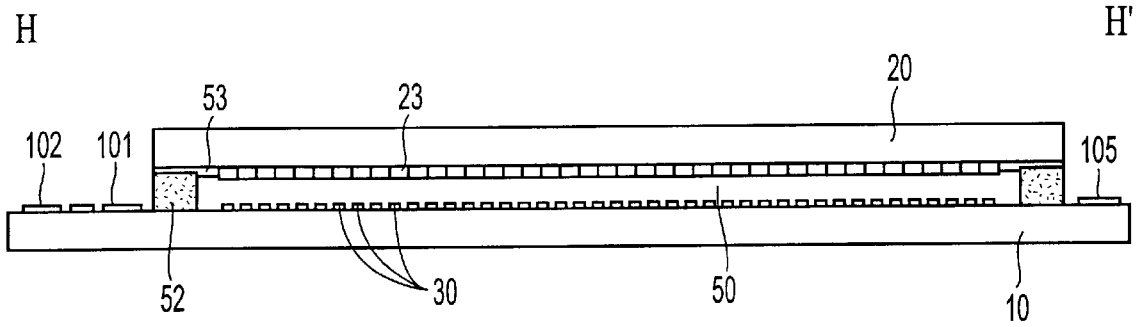
FIG. 12 is an H–H' sectional view of FIG. 11.

The overall construction of each embodiment of a liquid-crystal device constructed as described above is described with reference to FIGS. 11 and 12. FIG. 11 is a plan view in which a TFT array substrate 10, together with each component formed thereon, is viewed from the side of an opposing substrate 20. FIG. 12 is an H–H' sectional view of FIG. 11, showing, including the opposing substrate 20.

In FIG. 11, on the TFT array substrate 10, a sealing material 52 is provided along the edge thereof, and a light-shielding film 53 as a light blocking frame is provided in parallel to the inner portion thereof. In the area outside the sealing material 52, a data line driving circuit 101 and a mounting terminal 102 are provided along one edge of the TFT array substrate 10, and a scanning line driving circuit 104 is provided along two edges adjacent to this one edge. It is a matter of course that if the delay of a scanning signal supplied to the scanning lines 3*a* is not a problem, the scanning line driving circuit 104 may be provided on one side. Also, the data line driving circuit 101 may be arranged on both sides along the edge of the image display area. For example, it is possible for the data lines of the odd-numbered rows to supply an image signal from the data line driving circuit which is disposed along one edge of the image display area, and it is possible for the data lines of the even-numbered rows to supply an image signal from the data line driving circuit which is disposed along an edge on a side opposite to the image display area. If the data lines 6*a* are driven in the shape of the teeth of a comb in this manner, the occupied area of the data line driving circuit 101 can be expanded, making it possible to construct a complex circuit. Furthermore, in one remaining edge of the TFT array substrate 10, plural wirings 105 for connecting the section between the scanning line driving circuits 104 provided on both sides of the image display area are provided. Also, in at least one part of the comer portions of the opposing substrate 20, an up-and-down conductive material 106 for allowing electrical conduction between the TFT array substrate 10 and the opposing substrate 20 is provided. Then, as shown in FIG. 12, a liquid-crystal device is constructed in which the opposing substrate 20 having nearly the same contour as that of the sealing material 52 shown in FIG. 11 is securely fixed to the TFT array substrate 10 by the sealing material 52, and a liquid-crystal layer 50 is sealed by the TFT array substrate 10 and the opposing substrate 20. Also, on a side facing the liquid-crystal layer 50 of the opposing substrate 20, a light-shielding film 23, commonly-termed a "black mask" or "black matrix", for defining the aperture area of each pixel, improving the contrast ratio, and preventing mixing of colors between adjacent pixels, is provided.

A precharge circuit for writing a precharge signal of a predetermined electrical potential at a timing preceding to an image signal with respect to each of the data lines 6*a* in order to reduce the load of writing the image signal into the data lines 6*a* may be further formed on the TFT array substrate 10 of the liquid-crystal device in each embodiment described with reference to FIGS. 1 to 12 in the foregoing, or a check circuit for checking the quality, defects, and the like, of the relevant liquid-crystal device in the middle of manufacturing and before shipment may be further formed thereon. Also, a part of the peripheral circuits, such as the data line driving circuit 101, the scanning line driving circuit 104, and the like, may be electrically and mechanically connected to a driving oriented LSI mounted onto, for example, a TAB (tape automated bonding) substrate via an anisotropic conductive film provided in the peripheral portion of the TFT array substrate 10 instead of being provided on the TFT array substrate 10.

Furthermore, in each of the above-described embodiments, a light-shielding film made of, for example, a high-melting-point metal, may also be provided at a position (that is, on a side under the TFTs 30) opposing the TFTs 30 on the TFT array substrate 10. The provision of a light-shielding film also on a side under the TFTs 30 in this manner makes it possible to prevent returning light from the side of the TFT array substrate 10 from entering the TFTs 30.

Furthermore, on each of a side into which the projection light of the opposing substrate 20 enters and a side from which the incident light of the TFT array substrate 10 is output, a polarization film, a phase-difference film, a polarizer, and the like, are placed in a predetermined direction according to the operating mode, for example, a tn (twisted nematic) mode, an Stn (super Tn) mode, a D-Stn (double-STn) mode, or according to the difference of the normally white mode or the normally black mode.

The liquid-crystal device in the embodiment as described above can be applied to a color liquid-crystal projector. In that case, three liquid-crystal devices are used as light valves for RGB, respectively, and light of each color which is separated by a dichroic mirror for separating RGB colors enters, as projection light, each panel. Therefore, in the embodiment, a color filter is not provided on the opposing substrate 20. However, RGB color filters, together with their protective films, may be formed on the opposing substrate 20 in a predetermined area opposing the pixel electrodes 9*a* which are not formed with the light-shielding film 23. As a result of the above, the liquid-crystal device in the embodiment can be applied to a color liquid-crystal device, such as a direct-view-type and a reflection-type color liquid-crystal television, other than a liquid-crystal projector. Furthermore, microlenses may be formed on the opposing substrate 20 in such a manner as to have a one-to-one pixel correspondence. As a result of the above, the improvement in the light-gathering efficiency of the incident light makes it possible to realize a bright liquid-crystal device. Furthermore, by stacking many interference layers having different indexes of refraction on the opposing substrate 20, a dichroic filter for producing RGB colors by using interference of light may be formed. According to the opposing substrate with this dichroic filter, a brighter color liquid-crystal device can be realized.

Furthermore, as a switching element to be provided in each pixel, a positive-stagger-type or coplanar-type polysilicon TFT may be used. In addition, each embodiment is effective for TFTs of other forms, such as inverse-stagger-type or amorphous silicon TFTs. Also, in addition to TFTs, each embodiment is effective for transistors to be formed on a silicon substrate.

Next, an embodiment of an electronic apparatus comprising a liquid-crystal device 100 which has been described in detail up to this point is described with reference to FIGS. 13 to 15.

Figure 13:
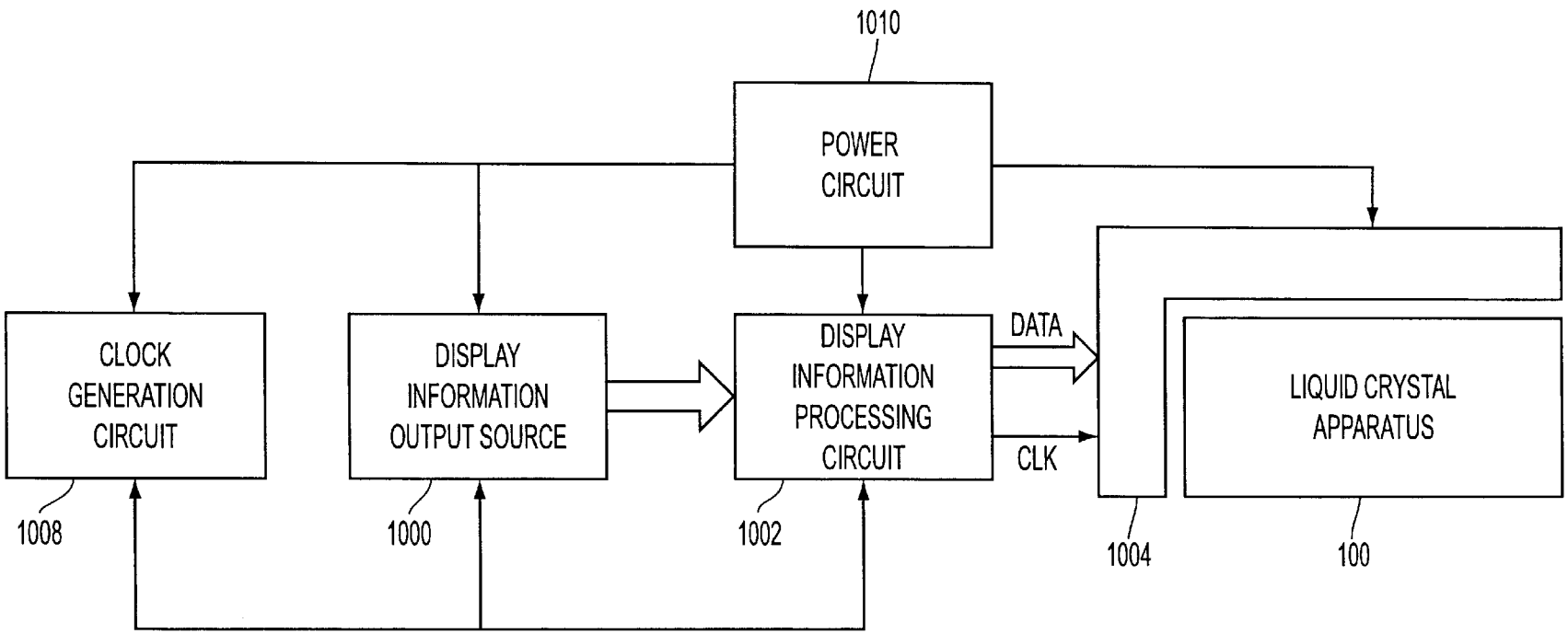
FIG. 13 is a block diagram showing the schematic construction of an embodiment of an electronic apparatus according to the present invention.

First, the schematic construction of the electronic apparatus including the liquid-crystal device 100 in this manner is shown in FIG. 13.

Referring to FIG. 13, the electronic apparatus includes a display information output source 1000, a display information processing circuit 1002, a driving circuit 1004, a liquid-crystal device 100, a clock generation circuit 1008, and a power circuit 1010. The display information output source 1000 includes memories, such as a ROM (read only memory), a RAM (random access memory), or an optical disk device, and a tuning circuit for tuning an image signal and outputting it. The display information output source 1000 outputs display information, such as image signals of a predetermined format, to the display information processing circuit 1002 in accordance with a clock signal from the clock generation circuit 1008. The display information processing circuit 1002 includes various known processing circuits, such as an amplification and polarity inversion circuit, a serial-to-parallel conversion circuit, a rotation circuit, a gamma correction circuit, a clamping circuit, and the like, generates a digital signal in sequence from the display information which is input in accordance with a clock signal, and outputs the digital signal, together with a clock signal clk, to the driving circuit 1004. The driving circuit 1004 drives the liquid-crystal device 100. The power circuit 1010 supplies predetermined power to each of the above-described circuits. The driving circuit 1004 may be mounted onto a TFT array substrate which is an element of the liquid-crystal device 100, and in addition, the display information processing circuit 1002 may be mounted thereon.

Next, specific examples of the electronic apparatus constructed as described above are shown in FIGS. 14 and 15.

Figure 14:
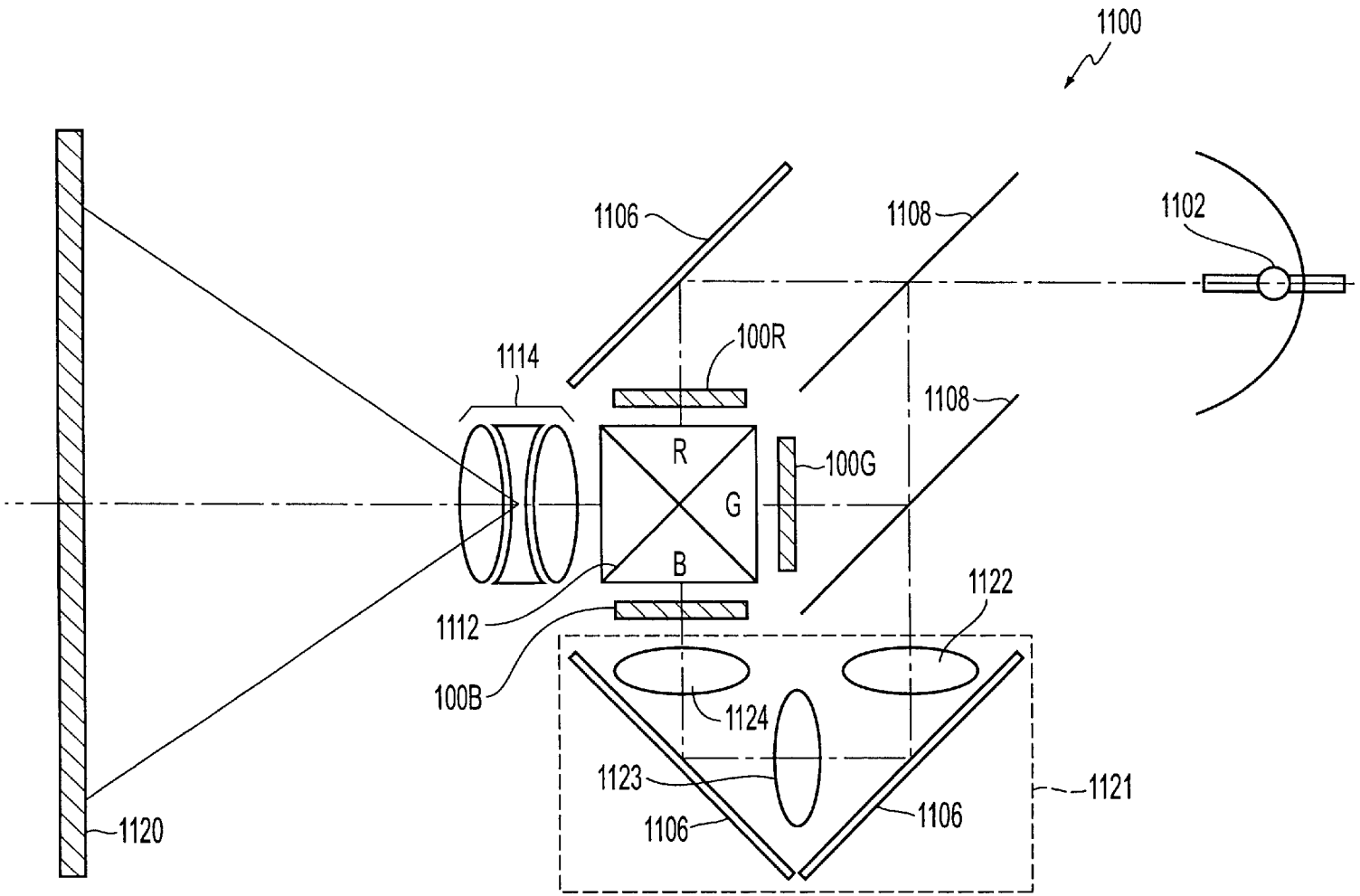
FIG. 14 is a sectional view showing a liquid-crystal projector as an example of the electronic apparatus.

In FIG. 14, a liquid-crystal projector 1100 which is an example of the electronic apparatus is constructed in such a way that three liquid-crystal display modules, including the liquid-crystal device 100 in which the driving circuit 1004 is mounted onto the TFT array substrate, are prepared, and these liquid-crystal display modules are formed as projectors which are used as light valves 100R, 100G, and 100B for RGB, respectively. In the liquid-crystal projector 1100, when projection light is emitted from a lamp unit 1102 for a white light source, such as a metal halide lamp, the light is separated into light components R, G, and B corresponding to the three primary colors of RGB by three mirrors 1106 and two dichroic mirrors 1108 and are guided into the light valves 100R, 100G, and 100B corresponding to each color, respectively. At this time, in particular, in order to prevent light loss due to a long light path, B light is guided via a relay lens system 1121 formed of an incidence lens 1122, a relay lens 1123, and an output lens 1124. Then, the light components corresponding to the three primary colors which are modulated by each of the light valves 100R, 100G, and 100B are combined again by a dichroic prism 1112, which light is then projected as a color image onto a screen 1120 via the projection lens 1114.

Figure 15:
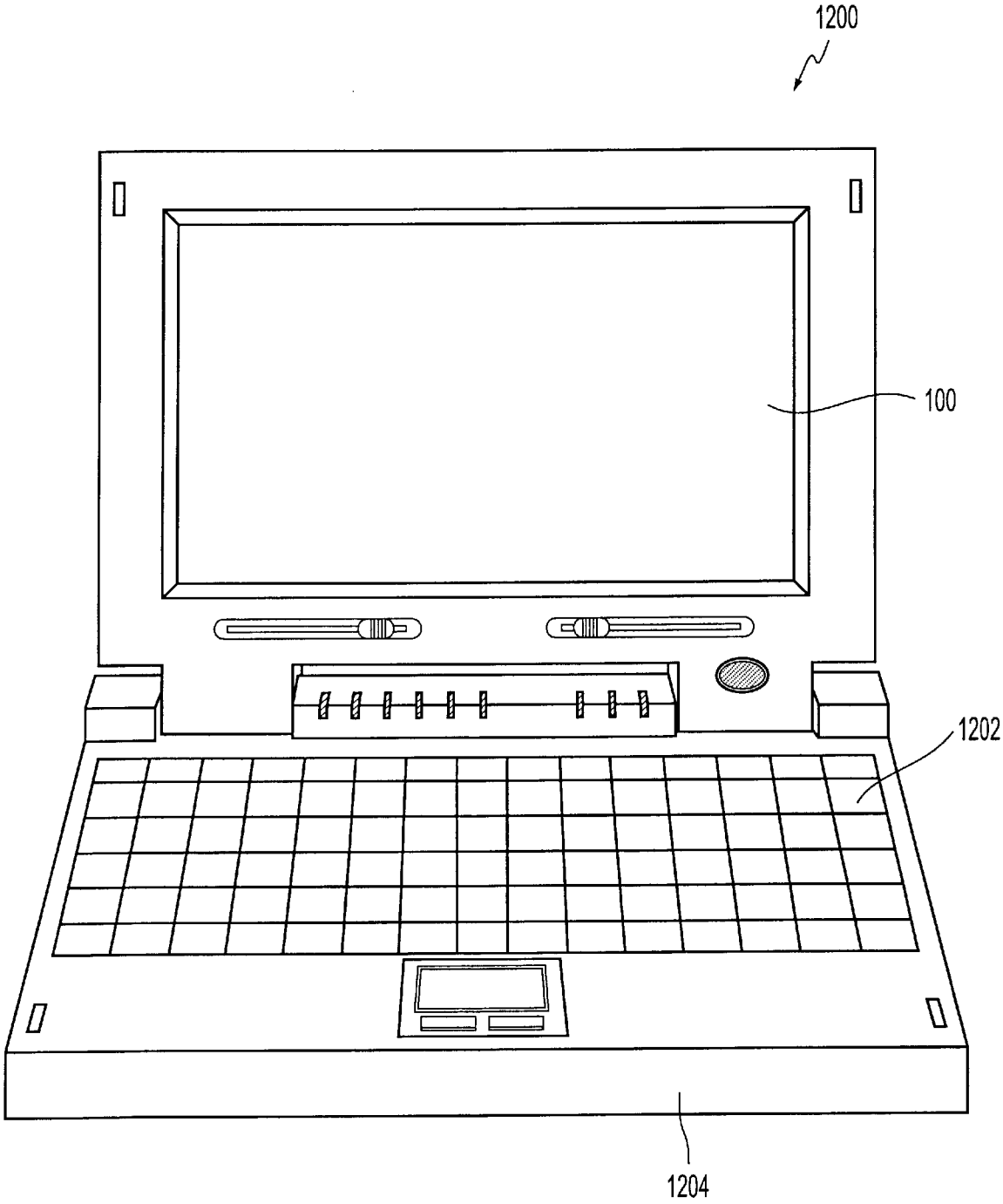
FIG. 15 is a front view showing a personal computer as another example of the electronic apparatus.

In FIG. 15, a multimedia-compatible laptop-type personal computer (PC) 1200, which is another example of the electronic apparatus, includes the liquid-crystal device 100 provided within a top cover case, and furthermore, a main unit 1204 having housed therein a CPU, a memory, a modem, and the like, and a keyboard 1202 incorporated therein.

In addition to the electronic apparatus described with reference to FIGS. 14 and 15 in the foregoing, examples of the electronic apparatus shown in FIG. 13 include a liquid-crystal television, a viewfinder-type or monitor direct-view-type video tape recorder, a car navigation apparatus, an electronic notebook, an electronic calculator, a word processor, an engineering workstation (EWS), a portable telephone, a videophone, a POS terminal, and an apparatus including a touch panel.

As has been described up to this point, according to this embodiment, it is possible to realize various electronic apparatuses including a liquid-crystal device, which has a high manufacturing efficiency and which is capable of displaying a high-quality image.

According to the electro-optical device of the present invention, while effectively using the area on the substrate, it is possible to provide a buffer circuit including an inverter formed of a large transistor capable of driving a load even if the load in the sampling circuit is increased with an increase in the number of data lines which are driven simultaneously, and it is possible for the driving circuit having saved space to perform satisfactory driving operation even in the case of a high dot frequency. Therefore, ultimately, while miniaturization of a substrate and a large image display area on a substrate of the same size are made possible, it is possible to display a high-quality image.

What is claimed is:

1. A driving circuit for an electro-optical device having plural data lines and plural scanning lines which intersect each other on a substrate, said driving circuit comprising:

plural sampling switches provided on said substrate, the sampling switches sampling image signals in accordance with a sampling control signal and supplying the image signals to said plural data lines, respectively, and a data line driving circuit that supplies said sampling control signal simultaneously to each group of sampling switches connected to n (n is an integer of 2 or more) data lines adjacent to said plural sampling switches, said data line driving circuit comprising:

a shift register circuit that sequentially outputs a transfer signal from each of a plurality of latch circuits, and a buffer circuit that outputs said transfer signal as said sampling control signal, said buffer circuit comprising at least one transistor extended in a same direction as a direction in which a width of a channel of the transistor would intersect the data lines.

2. The driving circuit for an electro-optical device according to claim 1, the channel of said transistor having a width which is within from 2 to n times a pitch of adjacent data lines.

3. The driving circuit for an electro-optical device according to claim 1, said buffer circuit including inverters of m (m is an integer of 2 or more) stages, the inverters being connected in series in such a manner as to correspond to each of said latch circuits.

4. The driving circuit for an electro-optical device according to claim 3, said channel width of said transistor possessed by an (i+1)-th inverter counting from a side of each of said latch circuits being larger than said channel width of said transistor possessed by an i-th inverter.

5. The driving circuit for an electro-optical device according to claim 3, said inverters of m stages being provided in a meandering shape such that a first portion of said inverters extending in a first direction intersecting said data lines from a side near said shift register circuit and a second portion of said inverters extending in a direction opposite to said first direction are arranged in sequence in a direction intersecting said scanning lines.

6. The driving circuit for an electro-optical device according to claim 5, further comprising a power wiring which extends in said first direction and is shared between said first and second portions.

7. The driving circuit for an electro-optical device according to claim 1, said buffer circuit including an inverter of one stage corresponding to each of said latch circuits.

8. The driving circuit for an electro-optic device according to claim 7, said inverter of one stage comprising plural inverters which extend in a direction intersecting said data lines and which are connected in parallel so as to be arranged in sequence in a direction intersecting said scanning lines.

9. The driving circuit for an electro-optical device according to claim 8, further comprising a power wiring which extends in a direction intersecting said data lines and is shared between said plural inverters which are connected in parallel.

10. The driving circuit for an electro-optical device according to claim 1, said transistor comprising a complementary transistor.

11. The driving circuit for an electro-optical device according to claim 1, said data line driving circuit further comprising a phase adjustment circuit for limiting a signal width of said transfer signal to a predetermined value between said latch circuit and said buffer circuit.

12. The driving circuit for an electro-optical device according to claim 1, further comprising, on one of said substrates, plural image signal lines arranged along said scanning lines, said buffer circuit being formed in an area on said substrate between said plural image signal lines and said shift register circuit.

13. The driving circuit for an electro-optical device according to claim 1, said image signal being subjected to n serial-to-parallel conversions and then supplied to said sampling circuit via n image signal lines.

14. An electro-optical device comprising a driving circuit for an electro-optical device according to claim 1.

15. The electro-optical device according to claim 14, further comprising plural pixel electrodes arranged in a matrix and plural transistors for driving the plural pixel electrodes, respectively, provided on one of said substrates, and said plural data lines and said plural scanning lines are connected to said plural transistors, respectively.

16. An electronic apparatus comprising an electro-optical device according to claim 14.

17. An electronic apparatus comprising an electro-optical device according to claim 15.

18. A driving circuit for an electro-optical device having plural data lines and plural scanning lines which intersect each other above a substrate, said driving circuit comprising:

plural sampling switches provided above said substrate, the sampling switches sampling image signals in accordance with a sampling control signal and supplying the image signals to said plural data lines, respectively, and a data line driving circuit that supplies said sampling control signal simultaneously to each group of sampling switches connected to n (n is an integer of 2 or more) data lines adjacent to said plural sampling switches, said data line driving circuit comprising:

a shift register circuit that sequentially outputs a transfer signal from each of a plurality of latch circuits, and a buffer circuit that outputs said transfer signal as said sampling control signal to a sampling control line, said buffer circuit comprising at least one transistor having semiconducting components formed between adjacent said sampling control lines, and said semiconducting components extending in a same direction as a direction intersecting an extending direction of at least one data line of the plural data lines.

19. A driving circuit for an electro-optical device having plural data lines and plural scanning lines which intersect each other above a substrate, said driving circuit comprising:

plural sampling switches provided above said substrate, the sampling switches sampling image signals in accordance with a sampling control signal and supplying the image signals to said plural data lines, respectively, and a data line driving circuit that supplies said sampling control signal simultaneously to each group of sampling switches connected to n (n is an integer of 2 or more) data lines adjacent to said plural sampling switches, said data line driving circuit comprising:

a shift register circuit that sequentially outputs a transfer signal from each of a plurality of latch circuits, and a buffer circuit that outputs said transfer signal as said sampling control signal, said buffer circuit comprising at least one transistor having a channel formed between adjacent said sampling control lines, and said channel extending in a same direction as a direction intersecting an extending direction of at least one data line of the plural data lines.

20. The driving circuit according to claim 19, the at least one transistor having a channel intersecting at least two data lines of the plural data lines when the at least two data lines are extended along the length of the at least two data lines.

21. The driving circuit according to claim 20, the at least one transistor having a channel intersecting more than two data lines of the plural data lines when the more than two data lines are extended along the length of the more than two data lines.

* * * * *